US008395565B2

(12) United States Patent
Somerville et al.

(10) Patent No.: US 8,395,565 B2
(45) **Date of Patent: *Mar. 12, 2013**

(54) TAGGED MULTI LINE ADDRESS DRIVING

(75) Inventors: Alan Somerville, Tokyo (JP); Kevin Jones, Kirchhem/Teck-Nabern (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 916 days.

This patent is subject to a terminal disclaimer.

(21) Appl. No.: 12/455,527

(22) Filed: Jun. 3, 2009

(65) Prior Publication Data

US 2010/0295860 A1 Nov. 25, 2010

(30) Foreign Application Priority Data

May 20, 2009 (EP) ..... 09368014

(51) Int. Cl.
*G09G 3/32* (2006.01)
*G09G 5/00* (2006.01)

(52) U.S. Cl. ..... 345/76; 345/82; 345/204

(58) Field of Classification Search ..... 345/76–82, 345/204, 690; 315/169.3
See application file for complete search history.

(56) References Cited

U.S. PATENT DOCUMENTS

| | | | | |
|---|---|---|---|---|
| 6,037,919 | A | 3/2000 | Hanson | |
| 2006/0107616 | A1 * | 5/2006 | Ratti et al. | 52/750 |
| 2007/0046603 | A1 | 3/2007 | Smith et al. | |
| 2007/0085779 | A1 * | 4/2007 | Smith et al. | 345/76 |
| 2008/0211793 | A1 | 9/2008 | Ku | |
| 2008/0246703 | A1 | 10/2008 | Smith | |

FOREIGN PATENT DOCUMENTS

| | | |
|---|---|---|
| WO | WO 2007079947 | 7/2007 |

OTHER PUBLICATIONS

Co-pending US Patent DS08-013, U.S. Appl. No. 12/454,609, filed May 20, 2009, "Back to Back Pre-Charge Scheme," assigned to the same assignee as the present invention.
Co-pending US Patent DS08-014, U.S. Appl. No. 12/454,625, filed May 20, 2009, "Advanced Multi Line Addressing," assigned to the same assignee as the present invention.
Co-pending US Patent DS08-015, U.S. Appl. No. 12/455,554, filed Jun. 3, 2009, "Extended Multi Line Address Driving," assigned to the same assignee as the present invention.
European Search Report 09368014.8-2205, Aug. 13, 2009, Dialog Semiconductor GmbH.

(Continued)

*Primary Examiner* — Stephen Sherman
(74) *Attorney, Agent, or Firm* — Saile Ackerman LLC; Stephen B. Ackerman

(57) ABSTRACT

A circuit for a flat panel display includes an image data storage and processing block, a display and timing controller block, an image pixel matrix containing a multitude of row and column arranged pixel elements, one or more controlled row and column driver blocks, and a tagged multi line addressing (TMLA) pixel element display operation. That TMLA operation comprises a decomposition of image data by searching all lines of an image for groups of identical lines by tagging each of these lines with a unique code and thus decomposes image data into multi line and single line domain data in such a way, that lines with matching tags, indicating their common and identical contents, are outputted as image data into related groups of the multi line domain with no left over residual image data and thus the related groups in the single line domain data are all zeroes.

27 Claims, 10 Drawing Sheets

OTHER PUBLICATIONS

"DS8622 WQVGA PMOLED Driver," [Online], Sep. 4, 2008, Dialog Semiconductor, XP002538448, URL:http://dialog-semiconductor.com/downloads/Dialog_PB_DA862x.pdf>, found on Jul. 7, 2008.

"How passive matrix OLED will change mobile displays and the role of SmartXtend driver technology," [Online], Feb. 2008, Dialog Semiconductor, XP002538447, URL:http://www.oled-info.com/files/SmartXtend_backgrounder.pdf>, found on Jul. 23, 2009.

* cited by examiner

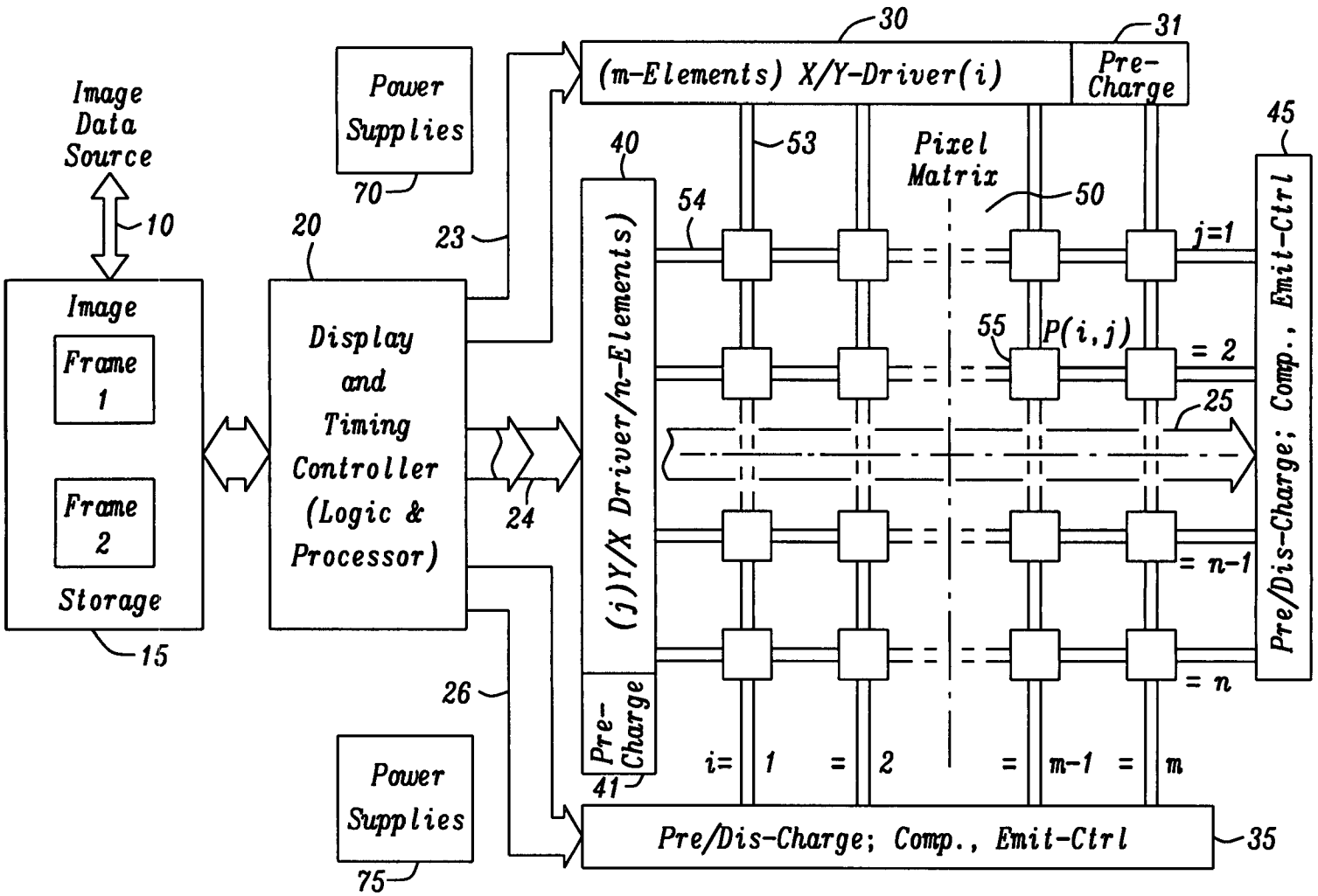
FIG. 1 – Prior Art

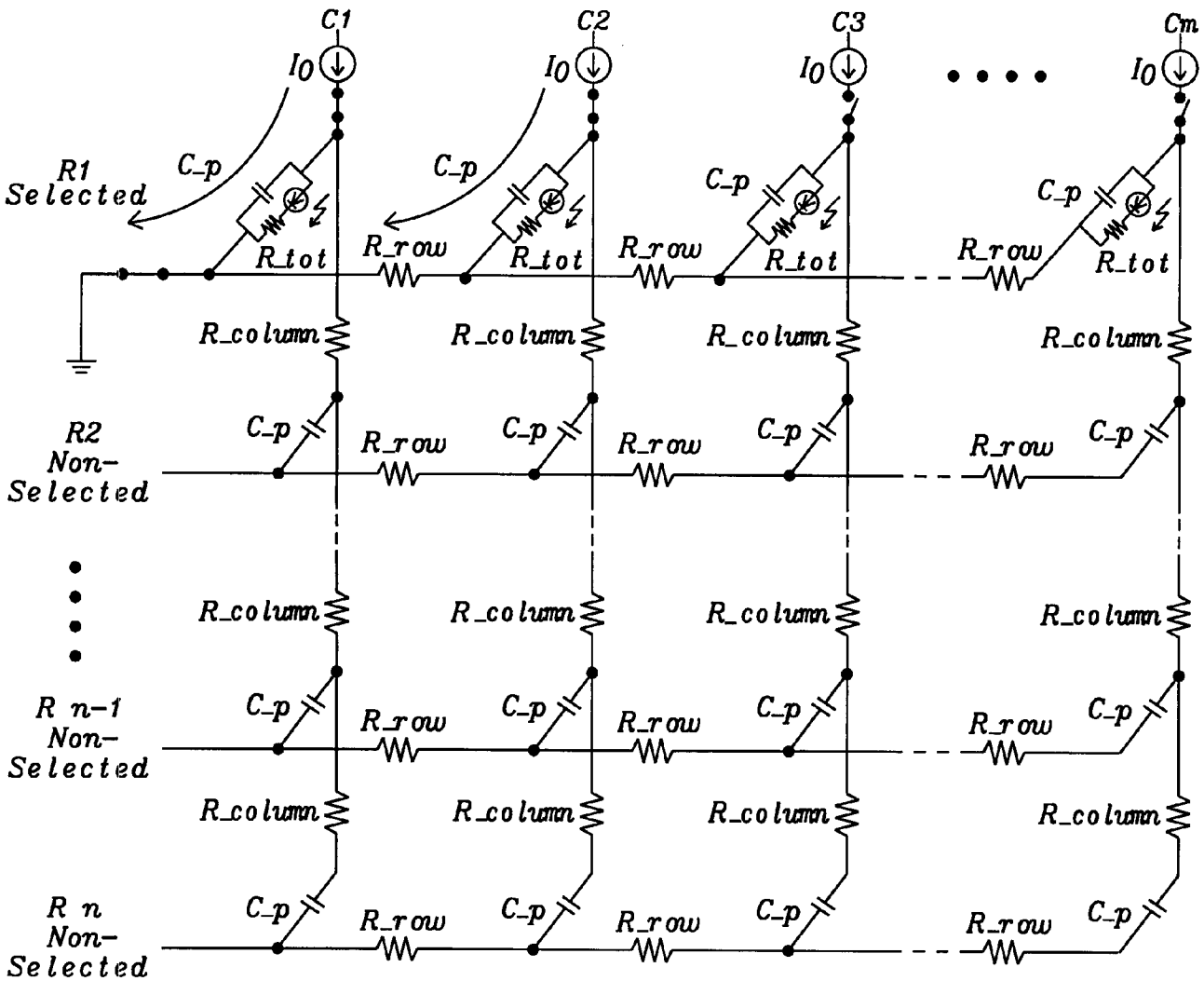
FIG. 2A – Prior Art

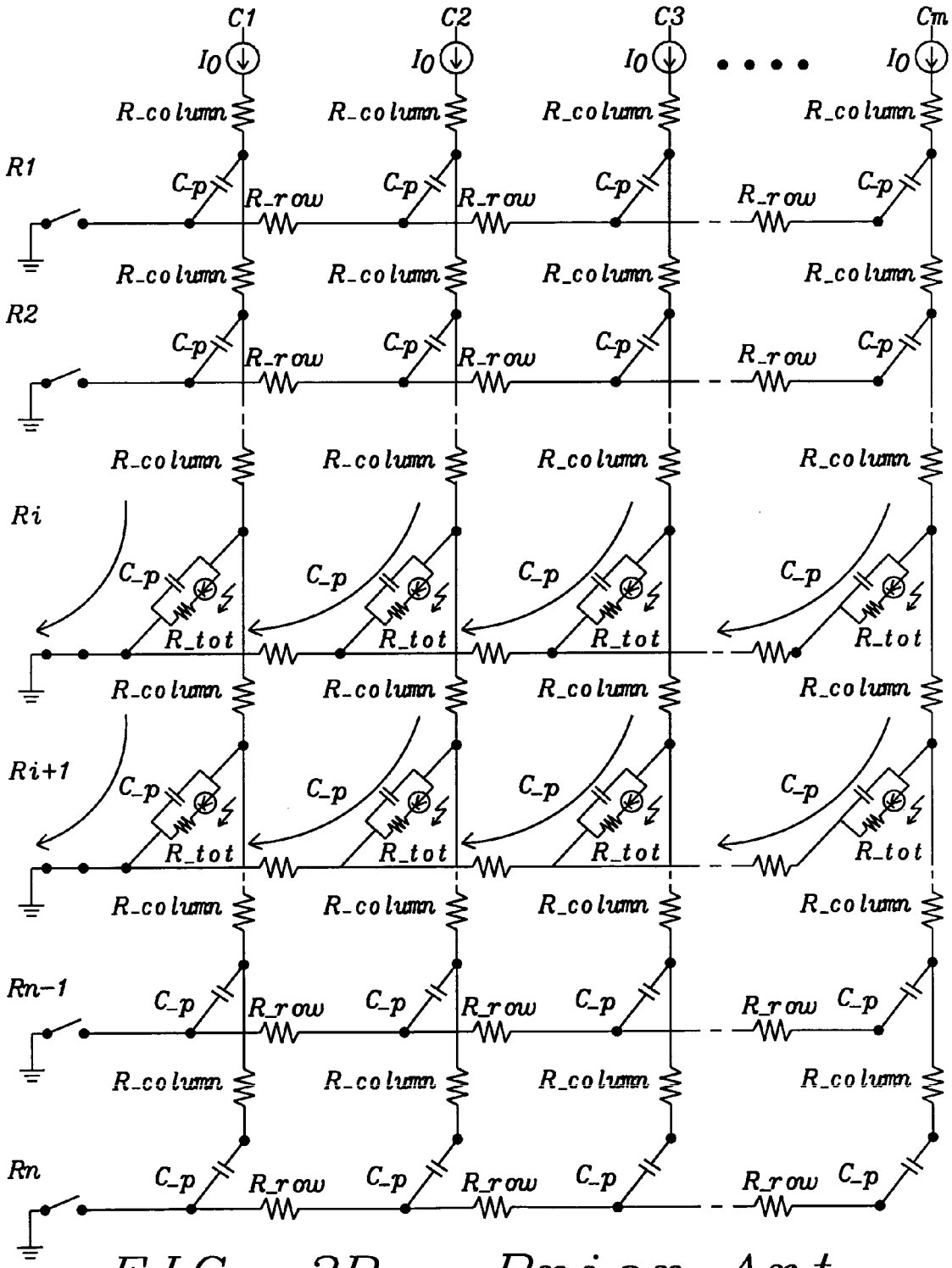
FIG. 2B – Prior Art

TAGGED MULTI LINE ADDRESS DRIVING

RELATED APPLICATIONS

This application is related to the following US patent applications:

titled "Back to Back Pre-charge Scheme", Ser. No. 12/454,609, filing date May 20, 2009 titled "Advanced Mult Line Addressing", Ser. No. 12/454,625, filing date May 20, 2009 titled "Extended Multi Line Address Driving", Ser. No. 12/455,554, filing date Jun. 3, 2009

The contents of all three of these applications are hereby incorporated by reference in their entirety.

BACKGROUND OF THE INVENTION (1) Field of the Invention

The present invention relates in general to image display devices, display panels, and driving methods thereof implemented within display driver circuits, and particularly to the drive circuitry of matrix large-screen and high resolution organic light-emitting diode (OLED) displays, especially circuits used in LED drivers manufactured as semiconductor integrated circuits. Even more particularly, this invention relates to a multi line address method saving calculations and processing power and optimizing performance as well.

(2) Description of the Prior Art

Electronic display devices are to date still from the LCD (Liquid Crystal Display) type fabricated in STN (Standard Twisted Nematic) or TFT (Thin Film Transistor) technology needing additional back-lighting but of late are more often also made as LED (Light Emitting Diode) displays in form of self-luminescent OLED (Organic LED) and PLED (Polymer LED also named as PolyLED) devices. Ever more such displays capable to exhibit their own luminosity without extra light sources are preferred. OLED technology incorporates organic luminescent materials that, when sandwiched between electrodes (anode, cathode) and subjected to a DC electric current, produce intense light of a variety of colors. Nearly the same is holding for PLED devices where polymer materials are used instead. Hence we will use in the following the terms OLED and PLED mostly in an exchangeable meaning. Similar capability can be achieved with Surface conduction Electron Emitter Displays (SEDs), High Dynamic Range (HDR) displays, Field Emission Displays (FED) and QDLED-Displays making use of Quantum Dot crystals. Currently OLED and PLED displays are commonly used, available in PMOLED (Passive Matrix) OLED and AMOLED (Active Matrix) OLED structure forms, differentiated by their driving methods and circuits. PMOLEDs are much simpler to manufacture than AMOLEDs because there is no TFT substrate for active components needed, and as a result fewer processing steps are required in the manufacturing line. OLED and PLED displays have several advantages compared to other display technologies: they are self-luminescing i.e. self-light-emitting not needing a backlight, do have high brightness and high luminance efficiency, exhibit short response times, a wide visual or viewing angle, a high contrast ratio, show a super-thin appearance (even flexible panel constructions are possible), they are power saving, offer a wide temperature tolerance, and so forth. OLEDs and PLEDs are also useful in a variety of applications as discrete light-emitting devices or as active elements for light-emitting arrays or displays, such as Flat-Panel Displays (FPD) of all kind and size. Depending on the types of substrates used for OLED and PLED manufacture, there are various types of implementations: Transparent OLEDs wherein transparent substrates for cathode and anode are used, which because of these transparent components can pass light in both directions and thus are especially useful in head-mounted display devices; Top-emitting OLEDs which use either opaque or reflective substrates, allowing light to be emitted in one direction only, and which are the most used types; Foldable OLEDs using highly flexible substrates, which help to reduce breakage of the display material thus allowing many new applications; and White OLEDs, used to emit white light which is brighter, more uniform and more energy efficient than other materials used for lighting.

The most obvious difference between PMOLED and AMOLED displays is the construction of their light-emitting elements or pixels. Such pixels of PMOLED devices are simply represented by the LED itself, created at the crossovers of the dedicated conductive matrix wires. No additional storage or switching elements are included, only the capacitance of the LED itself determines the lighting dynamics. The PMOLED display device therefore requires a relatively high amount of power to operate in order to sustain a flicker free image. In addition, the display size of a PMOLED display device is limited by this matrix structure. The larger the matrix becomes the longer the wires get with an increase of their harmful properties, such as resitivity losses on wires and parasitic capacitances between lines responsible e.g. for perturbing crosstalk effects. Furthermore, as the number of conductive lines increases, the aperture ratio of PMOLED display devices decreases. In contrast, AMOLED display devices are highly efficient and can produce a high-quality image for a large display size with relatively low power. In general, in an AMOLED display device, a voltage controlling a current applied to the light-emitting element or pixel is stored in a storage capacitor. Accordingly, the voltage in the storage capacitor can be applied to the pixel until the next complete image content or frame is fed in and the pixel can continuously display the image during that one frame. As a result, an AMOLED device has a lower power consumption, with high resolution even at larger display sizes because it is able to display complete image frames with a constant brightness in spite of low driving currents, at the expense of additional switching elements for each pixel however, whereby the switch is usually implemented as Thin Film Transistor (TFT). PMOLED displays can therefore generally be manufactured at a lower cost than AMOLED displays.

Although the PMOLED display has a simple configuration and an advantage in terms of cost, the difficulty in realizing a display with large size and high brightness as well as low power consumption and high lifetime is limiting its use. Therefore, the AMOLED display in which the current flowing in a light-emitting element is controlled by one or more TFTs and the related voltage is stored by a capacitor where both components are disposed in each of the pixel circuits has its own preferred fields of application. An AMOLED display device has problems however in that variations in component characteristics of the pixel circuit may exist and thus brightness of each pixel which make up the display screen may vary.

As is well known for OLED and PLED displays, optimum performance especially with high-brightness LEDs is achieved only when the LEDs are driven by current sources rather than by voltage sources, the currents of which are delivered by individually controlled display drivers with highly precise current sources directly driving the LED pixels, whereby the LED element of each pixel itself is an electric component with diode characteristics including also parasitic resistances and capacitances.

In the PMOLED case no further components are needed to build the picture elements or pixels for the dots of the display matrix. A pixel, by definition, is therefore a single point or unit of an image, whereby its color is to be chosen, for color displays in a real-time programmable way. In monochrome displays a pixel only displays a single color whereby that color is not individually changeable, only for the display on the whole at production time. However in color displays, a pixel is capable to individually change its color and therefore has to include an arrangement of so-called sub-pixels, at least one sub-pixel for each of its elementary color components according to the color dispersion method chosen, as for both, PMOLED and AMOLED devices.

In the AMOLED case however the OLED sandwich structures are combined with electronic switches (transistors or diodes, especially Metal-Insulator-Metal (MIM) devices) and separate charge storing elements (capacitors) to form pixels that make up the dots of a modern matrix display. Dots for color displays therefore generally comprise more than one pixel, and thus are made up of sub-pixels emitting for example red, green, blue and of late also white light, which are individually controlled and driven. Various differently complex sub-pixel circuits have been developed making additional use of several TFT transistors and storage capacitors in order to overcome onerous side-effects of the intrinsic light emissive material of the pixels—such as degradation during lifetime, delayed response times for activation and deactivation of the pixel, and the like.

With reference to the more elaborate sub-pixel circuits for ON/OFF controlling the organic or polymeric light-emitting cell of each sub-pixel there are the already known two elementary driving methods for PMOLED and AMOLED displays, one is the Passive Matrix (PM) driving method and the other is the Active Matrix (AM) driving method using TFTs. In the PM driving method, anode and cathode electrodes are arranged perpendicular to each other to selectively drive the lines. On the other hand, in the AM driving method, TFTs and a charge storing capacitor are coupled to the pixel electrodes so as to sustain a voltage by the capacity of the capacitor. According to the form of the signals applied to the capacitor to sustain the voltage, the AM driving method can furthermore fundamentally be divided into a voltage programming mode and a current programming mode, whereby of late the current programming mode is preferred as already mentioned above. OLED displays are thus normally operated as current-controlled display devices. Nevertheless, for high-content displays realized as large matrix arrays, a multiplexing mode is also a necessity. In this context, though OLED devices are essentially current-controlled devices, a voltage drive mode is chosen for a short period before the current drive mode is established, which is operating as charge drive for the parasitic internal parallel capacitances of the OLED sub-pixel diodes. The electrical model of a sub-pixel of an OLED consists of a Light Emitting Diode (LED) and the parasitic capacitance modeled by a capacitor in parallel. A sub-pixel thus emits light when current passes through the diode. In a current driving system, the constant current source connects to the sub-pixel to turn it on. This charges up the capacitor linearly. Before the sub-pixel voltage reaches the diode's threshold or forward voltage, there is no current flowing through the diode and the sub-pixel is still OFF. Supply current is consumed only for charging the capacitor during this period. If the capacitance is large the sub-pixel is off for a long time. And it is ON only after the sub-pixel voltage has reached the threshold voltage level. These parasitic capacitances may become rather large depending on the size of the sub-pixel. The time of their charging-up until reaching the sub-pixel diode's threshold voltage is thus referred to as pre-charge period. Therefore, for a multiplexed matrix OLED display, both a current drive and a voltage drive are required. Because larger OLED displays exhibit these high capacitance characteristics, a normally substantial pre-charge current is injected voltage driven to bring the diode up to near its operating current prior to enabling the diode. Thus, time and power are not wasted for charging and discharging the relatively high capacitance that is inherent to large OLED display sub-pixels and the lifetime of the diodes are prolonged because the diodes are not required to swing the full voltage range during each cycle. Consequently having driven the OLED sub-pixel by pre-charging into the constant current driven and linear time function voltage rising region a Pulse Width Modulation (PWM) brightness control method for OLED sub-pixels is now feasible with high accuracy. The longer the constant current is applied, the brighter the OLED sub-pixel shines.

Generally the PM and AM OLED technology provide bright, vivid colors in high resolution and at wide viewing angles, additionally also exhibiting a high response speed in large but nevertheless slim FPD devices. OLED devices' technological advantages of high brightness and high luminance efficiency, short response time and wide visual angle, together with its power saving operation and wide temperature tolerance, have established unequaled features for large screens, offering high resolution displays with up to several million pixels and diagonal sizes up to 60 inches. However, OLED technology in very large-screen or huge-screen display applications is currently still on its way into the mass market; examples include huge time-table displays at train stations, in airports, or at harbors, or displays for large marketing advertisements and mass-public informational purposes including those displaying share prices in stock exchanges, and huge indoor or even outdoor stadium displays. OLED color displays are expected to offer substantial advantages compared to other technologies currently in common use: wide dynamic range of colors, high contrast, superior light intensity and lesser depending on various external environmental factors including ambient light, humidity, and temperature. For example, outdoor displays are required to produce more white color contrast under daylight conditions and during the night show more black color contrast. Accordingly, light output must be greater in bright sunlight and lower during darker, inclement weather conditions. The intensity of the light emission produced by an OLED pixel is directly proportional to the amount of current driving it. Therefore, the more light output needed, the more current has to be fed to the pixels which on the other hand is detrimental to the lifetime of the pixels.

FIG. 1 Prior Art now shows as circuit schematics the drawing for such an FPD, wherein a matrix display device converts electric signals processed by an information processing device into an image, visible on a FPD screen. Numerous circuits for complete FPDs exist as prior art in many variants, they shall be summarized here in form of an exemplary circuit shown as FIG. 1 Prior Art:

From FIG. 1 Prior Art can be recognized an Image Data Source 10 being connected via a bi-directional data bus and feeding its image data stream normally comprising a multitude of image frames into an Image Storage 15 unit, capable of storing multiple image frames, whereby every image frame contains in general successive image data from said incoming image data stream. That Image Storage 15 unit is again bi-directionally connected to a Display & Timing Controller 20 unit, comprising inter alia data and/or signal Logic circuits and data and/or signal processing units.

Display & Timing Controller 20 unit then prepares and conditions those image frame data as they come in from the Image Storage 15 unit, and delivers these data now in an appropriately transformed manner via image data and control signal bus systems 23, 24, 25, and 26 to the respective, closely display matrix adapted electronic driver units 30, 35, 40, and 45 of the FPD's literal Pixel Matrix 50. The Pixel Matrix 50 of the FPD includes a plurality of X-Lines 53 (i=1, 2 . . . m−1, m) extended along a first direction of an array substrate serving as material medium for the screen, a plurality of Y-Lines 54 (j=1, 2 . . . n−1, n) extended along a second direction of the array substrate that is substantially perpendicular to the first direction, and a plurality of sub-pixel 55 elements P(i, j) each electrically connected to one of the X-Lines and one of the Y-Lines. In this manner a Cartesian X-Y system of coordinates is established, mathematically spoken. From the terminology of mathematics here also the designations used are derived. Each i, j-indexed pair of X-Y coordinates thus uniquely identifies a sub-pixel element P(i, j) within 55. Many other terminologies in the context of FPD designations are in wide-spread use however, depending on the point of view (POV) taken in explaining the configuration. A possible interchange of the sequence X-Y into Y-X comes from the fact that the designation of the axes is freely interchangeable with its coordinated line designations, in case of a PM-structure these axes are even functionally interchangeable, because the construction of PMOLED pixels is fully symmetrical; besides polarity of the OLEDs only, where anode and cathode are interchanged which can easily be accounted for by inversely adapted voltage polarities however. Most closely related are the terms Rows and Columns for the Y/X- and X/Y-Lines respectively, which use directly the mathematical matrix designations for these parts. Using topological terminology leads to Horizontal and Vertical, which is mapped to Y/X- and X/Y-Lines again. From an FPD operational POV the Y- and X-Lines are called Scan-Lines and Data-Lines respectively, which is a rather often used terminology in fact. This operational POV sees an FPD as an image display device including Data-Lines for transmitting image data voltages representing the image signals, Scan-Lines for transmitting appropriate multiplex select signals scanning the matrix, with sub-pixel circuits for each image point coupled directly to those Data- and Scan-Lines. An even more technical aspect leads to the electrical POV valid however for AM-displays only, namely Gate-Lines and Source-Lines stemming from the utilized TFT-switching transistors in AM sub-pixel circuits. This electrical POV sees a Scan-Driver driving an AM-display device having a plurality of Gate-Lines transferring multiplex scan signals, and a Data-Driver driving a plurality of Source-Lines transferring image data signals. Also from the technical or electrical POV often in use for PM-displays are the terms Anode and Cathode, reminding directly of the OLED's diode function. Thus the designations Anode- and Cathode-Lines are used, as well as Anode- and Cathode-Drivers. All these designations are used in the case of the dynamic operation of multiplexed FPDs. There is however also a static, non-multiplexed operation possible, using fewer pixels only, then the Y/X- and X/Y-Lines are called Segment-Lines and Common-Lines or vice-versa, which becomes evident from the arrangements for simple displays, e.g. the commonly used 7-segment cipher displays. It is furthermore obvious that in case of a PMOLED display it is arbitrary which lines are labelled Row lines and which Column lines, Rows and Columns can be used interchangeably. From a methodological POV, the X/Y- and Y/X-terminology is avoided if not only strictly symmetrical issues are concerned, which is seldom the case, also for PM-arrays; the Row/Column or Scan/Data designations are easier to understand and remember, the Gate/Source naming is usable for AM-structures only, and even there it is not simply applicable any more because of the complex pixel-circuits with diodes as switching elements etc., the Anode/Cathode terminology is popular instead.

Consequently the display matrix adapted electronic driver units 30, 35, 40, and 45 bear the following names for unit 30: X/Y-Driver or Data-Driver or Source-Driver or Matrix-Column- or Horizontal-Drive-circuit which is driving the vertically running X/Y-Lines, Data-, Source-, or Column-Lines. Unit 40 correspondingly becomes designated as Y/X-Driver or Scan-Driver or Gate-Driver or Matrix-Row- or Vertical-Drive-circuit again now driving the horizontally running Y/X-Lines, Scan-, Gate-, or Row-Lines. Unit 35 is a possible coordinated driver circuit usually performing auxiliary functions such as pre-charge or discharge operations, compensation signal adding or secondary emit control functions for its attributed X/Y-Driver or Data-Driver or Source-Driver or Matrix-Column-circuit 30. In the same manner is unit 45 a possible coordinated driver circuit also performing auxiliary functions such as pre-charge or discharge operations, compensation signal adding or secondary emit control functions for its attributed Y/X-Driver or Scan-Driver or Gate-Driver or Matrix-Row-circuit 40. It shall especially be mentioned that all these functions may also be incorporated into the main driver circuits 30 and 40 as shown in FIG. 1 Prior Art for the corresponding pre-charge sections 31 and 41 respectively. From this can then be deduced that all the horizontally 54 and vertically 53 running data, select, scan, and control signals 53, 54 leading to their related sub-pixel circuits within 55 are possibly bundled in signal bus lines comprising multiple wires. Equally should be mentioned that the display matrix area may be separated into multiple sub-areas used for displaying only partial frames, so-called sub-frames, together with an appropriate adaptation of corresponding driver circuits and data and control signals. In order to be able to fulfill all the necessary tasks the mentioned display driver circuits or units 30, 35, 40, and 45 may contain needed sub components such as memory registers, shift-registers, switches, multiplexers, voltage level shifter circuits, programmable voltage and/or current sources and/or sinks, and additional clocks or timers. FIG. 1 Prior Art also unveils the existence of several power supplies 70 and 75 intended for generating and/or delivering various voltages and currents for being used as e.g. Row ON/OFF Voltage Source, Column ON/OFF Voltage Source, or as Column Compliance Voltage Source, or as Pre/Discharge Source, or the like. The generated voltages or currents are used for OLED pixel operations like applying the Pre-charge Pulse, setting Display Sub-pixel ON/OFF or accelerating the pixel OFF responses by injecting an extra Discharge Pulse. During a multiplexed image display operation the Scan/Row-Lines 54 are activated in sequence. When one of the Scan/Row-Lines 54 is activated, a data signal is applied to the selected sub-pixel elements in 55 through the Data/Column-Lines 53, so that the respective sub-pixel elements in 55 are electrically activated. When these selected sub-pixel elements in 55 are electrically activated, normally all additionally estimated necessary or needed auxiliary signals are appropriately synthesized defining the drive or data signals for all the sub-pixel elements in 55 thus correctly controlling the entire display pixel 55 made up of different sub-pixels. As a result, an optical activity is enabled to display the desired image. The time period during which first through last Scan/Row lines are activated is referred to as one frame, in the case only of regular single sequential scanning operations however.

With FIG. 2A Prior Art a more detailed view onto the Pixel Matrix 50 from FIG. 1 Prior Art of an FPD with PMOLED display matrix is depicted, schematizing the current driving functions of the Data/Column 30 drivers and the scanning operations of the Scan/Row drivers 40 by showing switched constant current sources as well as simple switches instead for each Column and Row respectively. The OLED pixels on the other hand are represented together with their parasitic elements total resistance R_tot and parallel capacitance C_p, just the same as the Row and Column wires with their loss resistances R_row and R_column. No other components are comprised in the passive matrix diode display array. As operating example is shown a state with Row R1 selected, i.e. its according switch is closed and Columns C1 and C2 are ON with all other Columns OFF, i.e. the related switches are closed only in the first two columns and thus only there currents can flow, and if the threshold voltages of the two switched ON diodes are surpassed after the parasitic capacitances of these two diodes are sufficiently charged-up, the OLED pixels (1,1) and (1,2) are shining bright. From this description and drawing the need for pre-charging OLED displays is easy to understand, if fast responses are required. The influence of all the other parasitic and lossy elements in PMOLED displays is also clearly illustrated.

Several different addressing schemes are used for individual addressing of the display pixels 55 of a display matrix, whereby in fact the addressing designates the selection or activation of single sub-pixels within a certain OLED pixel 55 dot. In general the individual sub-pixels in a matrix row are activated or selected by a Matrix Row signal formerly designated also as Scan/Row signals for a Row Select Time, whereas the image data to be displayed are supplied via individual Matrix Column or Data/Column signal lines. The most common addressing scheme formerly used mainly for LCD devices is the so called Alt & Pleshko driving scheme. Hereby each Matrix Row is activated separately. At the time the respective Matrix Row is selected or scanned the required image Data signals are applied to the Matrix Column via their Data/Column lines. So each display sub-pixel in the selected Matrix Row will show its programmed brightness as controlled by appropriate PWM Data signals as already explained farther above, which means each dot displays its correct color in case of color FPDs. After all dots within one Matrix Row have been completely activated, the next Matrix Row will be selected until all Matrix Rows of the display have been selected one time to display a complete image frame. Thereby, as already mentioned above a frame is defined as the time it takes to select all Matrix Rows of the FPD in case of Alt & Pleshko and thus driving every Matrix Row exactly once.

However, the PMOLED displays used in many modern applications encounter several common issues when the displays become larger and especially if they should also display video streams with moving pictures. These issues include sensible higher power consumption, thus an elevated operating temperature and, the larger they get a slower frame response with poorer contrast. A lifetime reduction becomes noticeable too, especially when PMOLED displays are frequently in use for displaying moving pictures at higher frame rates. In order to improve the quality of PMOLED displays, new driving methods using more evaluated addressing schemes are required. Simple addressing schemes did always address only single lines or rows of an FPD matrix at a time, applying ordinary multiplexing techniques. They are therefore subsumed and known as Single Line Addressing (SLA) techniques. More sophisticated addressing or driving schemes are the Multiple Line Addressing schemes (MLA), also known as Multiple Row Addressing (MRA). Groups of Matrix Lines or Rows are simultaneously driven and encoded image information is applied to Matrix Columns as Data/Column signals. The Data/Column voltage signal is now applied to the corresponding Matrix Column so that the corresponding OLED sub-pixels are all driven at the same time with image data.

FIG. 2B Prior Art shall now illustrate a simple MLA operation, looking back onto the already explained passive OLED pixel matrix from FIG. 2A Prior Art. Two lines are taken as example here, which are addressed together, namely Row Rj and Row Rj+1. The corresponding Scan/Row drivers are again replaced here by simple switches, which are closed if the lines are selected. The individual Data/Column drivers are represented however by controlled current sources, therefore no switches are needed here. As can be seen from the drawing, all the diodes within rows Rj and Rj+1 are connected to these controlled current sources and are therefore driven two in parallel in each column, that is in the example chosen here. From every Data/Column current source in MLA FPD driver circuits there is always the sum of currents drawn for all the OLEDs selected in multiple lines. Supplying all the diodes in the selected rows together at the same time thus always makes necessary exactly that same multiple of the current which would drive only one diode to the same brightness, the multiple according to the number of lines used in the MLA scheme. Additionally all the MLA schemes have to take into account the provisions to be made for needed pre-charging methods, which as a matter of course have also to be applied here, however considering the multiple demand of current just in the same way as for the Data/Column driving currents. What also can be understood easily from here, is the fact that all the OLEDs from each of the lines in an MLA scheme which are being driven simultaneously together can only receive identical contents, because of their identical Data/Column driving currents they receive.

Coming back now to PMOLED displays, where each Horizontal line is driven by a Row driving image Scan signal, and each Vertical line is driven by a Column driving image Data signal, it shall be recalled that the Row/Scan driver applies its Scan signal to one selected horizontal Row; while the Column/Data driver normally supplies all its image Data signals to all the vertical Column lines at the same time in conformity with the image Data content of the line being selected by the Row/Scan signal. Each pixel connected to its vertical Column line of the display now has power applied to it and is therefore illuminated. This driving mode is also designated as Single Line Addressing (SLA) mode. Having large numbers of vertical Column lines results in large currents to charge many OLED pixels at once. Therefore sometimes the exact points in time for the image Data supplied by the Column/Data driver are slightly delayed against each other, that is evenly distributed over the time slot available for the activation of the pixels of the whole row in order not to overly load the power supplies for the drivers. In other words, to create an image for every Row the Row/Scan signal is maintained as each of the Column lines is activated in turn until the complete Row has been addressed, and then the next Row is selected and the process repeated until all Rows are completed. Preferably is, however, to allow individual pixels to remain on for a longer time and hence reduce the overall drive level. The conventional method of varying pixel brightness is to vary the ON-time of each pixel using Pulse Width Modulation (PWM). In a conventional PWM scheme a pixel is either fully ON or completely OFF but the apparent brightness of a pixel varies because of an over the time integration within the observer's eyes. An alternative method is to vary the pixel driving current. Thus absolute current value and duration of the current flow for the driving Column/Data pulse can be played off against each other. Therefore current level can be lower if time is longer to obtain the same brightness impression. Thus usually one Row is selected and all the Columns are written in parallel despite of the summed-up current load this creates, that is a current is driven onto each of the Column lines simultaneously to illuminate each pixel in a Row to its desired brightness. The method mentioned above, where each pixel in a Column is being addressed in turn before the next Column is addressed is not often used because, inter alia, of the effect of column capacitance.

As already mentioned farther above it is usual practice to provide a current-controlled rather than a voltage-controlled Column/Data drive signal to an OLED because the brightness of an OLED is determined by the current flowing through the device, thus determining the number of generated photons. In a PMOLED matrix configuration the brightness can vary across the area of a display and also with operation time, temperature, and age, making it difficult to predict how bright a pixel will appear when driven by a voltage. Especially in color displays the accuracy of color representations may be affected. Another major challenge with using PMOLED in high resolution displays is that the operating lifetime is limited, as already adumbrated. The reason for this is that the current must be injected into each pixel diode within one horizontal line period, during which each row is selected. This means that as the resolution is increased a higher current must be injected into the pixel OLED over a shorter period of time in order to achieve the desired brightness. This high current accelerates the aging process that occurs inside the OLED, reducing the intensity of its light output over time; AMOLED displays do not have this limitation to the same degree, since the current can be injected during the whole vertical image frame period.

Many different MLA schemes exist. Modern MLA schemes have been further expanded and continuously developed into the Consecutive MLA (CMLA) scheme, a rather complex matrix decomposition method combining MLA and Single Line Addressing (SLA) techniques described in the WIPO Patent Application (WO/2007/079947 to Xu et al.) cited below, which however not in all cases delivers optimal solutions, sometimes even augmenting the number of necessary charging operations. Total Matrix Addressing (TMA) from U.S. Patent Application (2008/0246703 to Smith et al.) also cited below, despite and eventually because of its need of substantial processing power, is also not very satisfactory concerning overall efficiency in terms of power saving.

As can already be seen from the above the goal to both get the benefits of MLA schemes for FPD driving and at the same time limit the processing power requirements in favor of a low power consumption and augmented life-time of the whole FPD product is not easy to attain, a multitude of MLA schemes have been proposed with varying success given the surplus expenses needed.

Even though focus in the parts above has been mainly on Passive Matrix (PMOLED) solutions, a comparison of Active and Passive Matrix technology shall be given in the following passages.

Active vs. Passive Matrix—Introduction and Overview:

Instead of the above-mentioned simple matrix or passive matrix electro-optical display only, an active matrix driving in which additional electrical components forming separate active pixel-circuits are provided for each pixel and sub-pixel elements has many advantages and offers many other possibilities for additional tasks.

In comparison to the passive matrix driving, a light emitting display device using the active matrix is driven by a pixel or sub-pixel circuit with at least one transistor and a storage capacitor (electric condenser) to maintain a voltage by the storage condenser capacitance which in turn controls the driving current for the light emitting element. Each light emitting device in a passive matrix type display apparatus emits light only at an instant when the light emitting device is selected, whereas a light emitting device in an active matrix type display apparatus continues emitting light even after completion of writing. Thus, the active matrix type display device is advantageous especially for use as a large high-definition display in that an active matrix type display device can decrease peak brightness and peak current of the light emitting element as compared with a passive matrix type display device.

An OLED as light emitting element in an electro-optical device has a low viewing angle dependency because of its self-luminous type, and does not need a backlight or a reflected light illumination. OLEDs constitute a particularly advantageous form of electro-optic display. They are bright, colorful, fast-switching, provide a wide viewing angle and are easy and cheap to fabricate on a variety of substrates. OLEDs may be fabricated using either polymers or small molecules in a range of colors (or in multi-colored displays), depending upon the materials used. On this accounts, it has excellent characteristics as a display panel, such as its relatively low power consumption and the adaptability to being made thin. The OLED element e.g. is an electrical current type passive light emitting element in which a light-emitting state can not be maintained when the electrical current is cut off, because it does not have a voltage holding characteristic like a liquid crystal element. For this reason, when the light emitting element is driven in an active matrix method, a configuration is generally used in which a voltage corresponding to gray scale of a pixel is applied to a gate of a driving transistor, the voltage is hold by the gate capacitance, and a current corresponding to the gate voltage is input to the light emitting element by the driving transistor during a writing and driving period (selection period).

Important aspects of the active matrix structure and pixel element circuits and distinct facets of used principles and methods as well as problems and solutions concerning the many already existing active-matrix display solutions shall now be listed and described, or at least mentioned here for reference.

Active Matrix Structure:

A plurality of scan and data lines controlling the display matrix pixel and sub-pixel circuit and their operation plus a variety of additional specific control signals altogether powered by multiple different supply voltages and currents at various levels are used in conjunction with various known active-matrix display solutions. Usually a light emitting display device includes a data line, multiple signal lines, a pixel circuit, and a data driver for supplying a precharge current to the data line according to a control signal and supplying a data current to the data line according to another control signal.

Pixel Element Circuits:

Various internal components (preferably in thin-film technology) comprised in the pixel sub-circuits such as multiple transistors and/or diodes for switching and driving operations by voltage controlled current supply (e.g. with current mirrors) plus extra accumulation or storage capacitors adapted to their specific pixel or sub-pixel elements are implemented by different known active-matrix display solutions. To effectively reduce or prevent the deterioration of display quality caused by the errors caused by unwanted variations in the current supplied to an electro-optical element the pixel circuit is used.

Principles and Methods:

An active matrix method may include a voltage programming method or a current programming method, depending upon signal forms supplied for programming the voltage at a capacitor within each of the pixel sub-circuits. An important benefit of the conventional current programming type pixel circuit is that the current which flows to the OLED has a substantially uniform characteristic over the whole panel, compared to the voltage programming type pixel circuit.

In order to precisely control brightness in an electro-optical device, the amount of power supplied to the light emitting elements must be precisely controlled. In particular, because OLED light emitting elements are current-driven type electro-optical elements, the brightness is directly affected by the current. Hence there is a need to precisely supply the desired current to organic light emitting elements; and in addition to optimizing the driving circuit and driving method, the pixel layout must also be optimized. Problems encountered in actual pixel layouts include, for example, contact between pixel electrodes and peripheral circuitry, stability of holding capacitances, and transistor turn-off currents.

The display driver circuitry for electro-optic displays may include a driver to drive a light emitting element in accordance with a drive voltage, but also a photosensitive device optically coupled to the light emitting display element to pass a current dependent upon illumination reaching the photosensitive device and thus controlling the driver according to the environmental lighting. The circuit can then be operated in a number of different modes and provides flexible control of an electro-optical display element such as an OLED pixel.

The control circuit which includes a charge storage capacitor and a photosensitive device coupled to the storage capacitor for regulating charge stored on the storage capacitor in accordance with light falling on the photosensitive device may further comprise means for the independent voltage control of a gate terminal of the photosensitive device, preferably a phototransistor. In this way a more efficient and flexible biasing of the phototransistor is possible. In addition, it becomes possible to use the phototransistor as a TFT switch. This dual function (phototransistor/TFT switch) enables the pixel circuit to provide additional features; for example duty-cycle techniques for motion blur compensation. The inclusion of the photosensitive device improves the uniformity of the display and compensates for aging effects of the display device. The photosensitive device is a phototransistor having a gate terminal, which is attached to the anode of the light emitting display element, an OLED e.g. The phototransistor is not driven to be conductive and therefore acts as a photodiode responding almost linearly to the incident light.

Duty-cycle techniques for motion compensation will be applied especially for moving images. By switching the phototransistor on, the gate voltage of the driving transistor is set to the power line voltage. This turns the drive TFT off, and no current flows through the PLED. In this way the light output can be prematurely stopped. In still images this is not required.

In a light emitting device performing image display additionally separate non-volatile memory circuits may be contained in every one pixel. Thus the electro-optical device has a function for storing frame portions of the digital image signal in the volatile memory circuits. By performing display of a static image in accordance with repeatedly reading out, for each frame, the digital image signal stored once in the memory circuits and performing display, drive of a source signal line driver circuit can be stopped during that period. Further, a digital image signal stored in the non-volatile memory circuits is stored even after a power source is cut off, and therefore display is possible immediately when the power source is next turned on.

A light emitting display device which includes active pixel circuits may also be used for displaying images both on its front-side and its back-side as well as in all possible directions of operation i.e. used as rectangular display in all vertical and horizontal positions. Thus each of the pixel circuits have to be operated by at least two different scan signals therefore being capable of performing a bi-directional scanning operation. The light emitting display includes a bi-directional signal transmission shift register, the pixel circuits, and a scan signal applier. Each of the pixel circuits has therefore to be provided with two or more scan lines. The shift register then outputs signals in their respective directions in response to related control signals. The scan signal applier sequentially applies, to the scan lines of the pixel circuits, scan signals corresponding to their respective direction control signals. The display device comprises further a bi-directional data driver including a bi-directional shift register to bi-directionally apply a data signal. That is, in an OLED display e.g. capable of implementing a double-sided display, images displayed on the front and back screens of the OLED display are horizontally inverted from each other (e.g., left to right and right to left). In order to display the same image on the front and back screens, accordingly, the order of applying data signals to the data lines in association with the image display on the front screen must be bi-directionally applied or reverse to the order of applying the data signals to the data lines in association with the image display on the back screen. For example, the last data signal to be applied to the last data line for the image display on the front screen must be applied to the first data line for the image display on the back screen. On the other hand, where it is desired to display the same image even when the display panel is inverted in the vertical direction as well as in the horizontal direction, for example, in accordance with a 180-degree rotation thereof (e.g., up to down and down to up or top to bottom and bottom to top), the scan driver must also use a bi-directional shift register to bi-directionally apply a scan signal, similar to the application of the data signal by the bi-directional data driver. That is, in the case of an OLED display including a 180-degree-rotatable display panel, a bi-directional scan driver is used to change the order of sequentially applying scan signals to scan lines between the sequential selection of the scan lines in a downward direction (forward scan) and the sequential selection of the scan lines in an upward direction (backward scan), and thus, to display the same image on the screen in both the non-rotated state and the rotated state. For example, the bi-directional scan driver applies the first scan signal, to be the first scan line in a forward scan mode, to the last scan line in a backward scan mode, and applies the last scan signal, to be applied to the last scan line in the forward scan mode, to the first scan line in the backward scan mode.

Problems and Solutions:

In the following some of the arising problems in conjunction with electro-optical displays and their proposed solutions are listed.

For typical pixels of the OLED display device of an active matrix system the light emission luminance of the OLED is controlled by an active device driving circuit constituted by TFT switch transistors and driver transistors, and an accumulation capacitor. More specifically, in its simplest case, the voltage corresponding to the electric charge which is accumulated in the accumulation capacitor through the switching transistors provides the gate voltage of a driver transistor, and the OLED is driven by the current which is determined on the basis of the gate voltage. However, in actual reality, there arises the problem that a display unevenness of the display picture is caused due to the non-uniformity of the threshold voltage and the charge drift mobility of the driver transistor.

An organic light emitting diode circuit used in organic light emitting display normally stores signals for controlling the luminance of an OLED via thin film transistors (TFTs) and capacitors. However, these TFTs, after prolonged use, will exhibit a threshold voltage shift. This shift amount is related to the operation time of the TFTs and the current flowing therethrough. In a display process, owing that the TFT for driving an OLED for each diode has a different current when turned on, and the driving TFTs will have different shift amounts of threshold voltage. As a result, the luminance of each diode will not have the same correspondence relation as the received pixel data, which in turn results in an uneven frame display.

In order to solve the above issue, voltage compensation techniques are applied to conventional OLEDs. In the above mentioned compensation technique, the compensation operation is performed during a data writing period to eliminate errors generated from the threshold voltage. However, recent OLED panels tend to be developed in high resolution and large size. As a result, the time for writing data is greatly reduced. However, the switching TFT has small current as it is turned on, and thus it needs longer compensation time, which will result in an irregular operation of the switching TFT and disability of the compensation mechanism. However, with the circuit design of a conventional voltage compensation arrangement, it is essential that the nodes connected to both X and Y line nodes have a stable voltage state during the "data writing" stage, otherwise, a charge sharing issue will be generated at the frame display stage. Accordingly, the conventional voltage compensation arrangement is apt to exhibit the drawback that the the node X does not reach a stable voltage state for canceling the threshold voltage of the driving TFT to be compensated due to inadequate time. In this situation, the switching TFT is still turned on. As a result, the charge sharing issue is generated and the display luminance can not reach the predicted luminance in correspondence with the pixel voltage. Voltage compensation techniques are thus used employing different levels of reference and supply voltages.

Another proposal is, that the magnitude of the current value of the writing current is temporally increased within the writing cycle, whereby the writing current is limited to a low level (or zero) in an early stage of the writing cycle. Thus, the average value of the writing current may be reduced. Additionally also a bias circuit for applying a bias voltage to the gate of the current supply transistor and thus producing a gate driver with improved reliability is proposed.

Display irregularities such as crosstalk, which develop due to a drop in voltage caused by the wiring resistance of electric current supply lines in an electro-optical device can also be avoided with active matrix technologies.

Display device solutions having a reduced data programming time are important and include a pixel display circuit which makes it possible to shorten a selection period per pixel while compensating variations in the threshold voltage of the driving transistor. The pixel circuit of the current programming method produces a long data programming time since it must charge and discharge parasitic capacitances generated at the data line. That is, the data programming time in the current programming type pixel circuit is influenced by the level of a voltage stored in the parasitic capacitance of the data line by the data current of the previous pixel line, and in particular, the data programming time is increased when the difference between the voltage of the data line and a target voltage (a voltage which corresponds to the current data) is large. In other words, the time for programming the data on the current pixel line is influenced by the voltage state of the data line according to the data of a previous pixel line, and in particular, the data programming time is further lengthened when the data line is charged with a voltage which has a large difference from the target voltage (the voltage corresponding to the current data). This phenomenon becomes the more important the lower the gray level (near black) or the higher the luminosity of color sub-pixels is.

Most voltage-control solutions allow the compensation of the threshold voltage fluctuations, but not also the compensation of fluctuations of the charge carrier movement. Additional TFT components for a current measuring- and voltage regulating circuit and a split conductor configuration are used which together are low-ohmic, so that in total very short response times are reached.

Another implementation of an active matrix display device has a monitoring portion which detects change of ambient temperature and degradation with time, provided with a plurality of monitoring pixels and a monitoring line. Each of the plurality of monitoring pixels has a light emitting element for monitoring, a constant current source, a switch, and a detecting circuit, and one electrode of the light emitting element for monitoring is connected to the monitoring line through the switch.

A technique, using a selection criteria for identification of any defective pixels in a matrix display during the initial screening and during operation has been established. According to this technique, the stability of the OLED can be checked by applying a reverse voltage over the OLED and detecting the resulting leakage current variation over time. Such a leakage current is small in the ideal device, but will be significantly larger if a defect is present. Therefore, defective pixels can be identified. On the contrary, in forward mode when the diode is ON, the current flowing through the diode is large, and any current contribution from a defect is hidden. The same effect can be utilized for using the pixel as a sensor. When subject to external influence, such as light, temperature, color, radiation or physical contact, the leakage current of the OLED will be altered. This alteration can be detected in the same way as mentioned above with regards to defects in the OLED. Techniques for correcting pixel defects have also been proposed for passive and active matrix displays. Strong voltage pulses are applied to an OLED in reverse mode. This high field can induce a high current to either heal or isolate a defect in a pixel.

Again another active matrix display device provides an image display that has an especially satisfactory display quality for animated images. A light emitting control switch means makes it can set a non-emission period of light between two consecutive frames by controlling a light-on time of the light emitting means in one frame. By setting an appropriate non-emission period of light, the afterimage effect that had appeared on the human visual property will lessen sufficiently within this non-emission period of light. Accordingly, the images for continuing two frames will not be superposed visually, which permits a smooth animated image display.

An active matrix OLED (AMOLED) display device may also make use of more sophisticated pixel and sub-pixel circuits whereby the scan driver includes a plurality of shift registers to output signals that are sequentially shifted, each of the shift registers controlling a start signal and more than two clock signals; and an output part to selectively output these clock signals and to switch between multiple supply voltages, which are different from each other, and which are switched for application to the pixel and sub-pixel circuits.

AMOLED displays may also comprise pixel electrode and display circuits capable of lowering power consumption with a uniformity of luminance retained, and realizing a display image having a high contrast and a high image quality, wherein additionally to the regular write and drive period for storing the written data signal and driving an OLED element in drive periods within the pixel control interval a correction period for correcting a variation in properties of internal drive transistors in a pixel circuit during a frame is used. Thus the pixel drive is controlled so that an interval having the correction period, the write period, and the drive period, and an interval having the write period and the drive period without the correction period exist.

This concludes the comparison of Active vs. Passive Matrix circuits.

A variety of solutions is found in the prior art for driving, controlling and addressing OLED displays in an attempt to simultaneously reach the two competing goals namely reaching high accuracy for OLED displays' brightness control and low power consumption and effectiveness in continuous operation. Nevertheless, additional improvements in both fields are desired and continued improvements in these areas are needed. It is therefore a challenge for the designer of such circuits to achieve an even higher accuracy in OLED pixel brightness control and also a more power economical solution which is also furnishing a better life-time. There are various patents referring to such solutions.

WIPO Patent Application (WO/2007/079947 to Xu et al.) teaches a method for triggering matrix displays, wherein matrix displays (D) are described which are composed of several rows that comprise individual pixels (ij) and are configured as lines (i) and columns (j). In said method, individual rows are selectively triggered by activating lines (i) for a certain line addressing time (ti), and the columns (j) are impinged upon by an operating current (l) or a corresponding voltage in correlation with the activated line (i) according to the desired brightness (Dij) in the pixels (ij). In order to increase the performance of the display, the line addressing time (ti) for each line (i) is defined in accordance with the maximum brightness of all columns (D).

U.S. Patent Application (2007/046603 to Smith et al.) provides multi-line addressing methods and apparatus, whereby this invention relates to methods and apparatus for driving electroluminescent, in particular organic light emitting diodes (OLED) displays using multi-ling addressing (MLA) techniques. Embodiments of the invention are particularly suitable for use with so-called passive matrix OLED displays. A current generator for an electroluminescent display driver, the current generator comprising: a first, reference current input to receive a reference current; a second, ratioed current input to receive a ratioed current; a first ratio control input to receive a first control signal input; a controllable current mirror having a control input coupled to said first ratio control input, a current input coupled to said reference current input, and an output coupled to said ratioed current input; said current generator being configured such that a signal on said control input controls a ratio of said ratioed current to said reference current.

U.S. Patent Application (2008/0246703 to Smith et al.) discloses display driving methods and apparatus for driving a passive matrix multicolor electroluminescent display, wherein a method of driving a passive matrix multicolor electroluminescent display is teached, the display comprising a plurality of pixels arranged in rows and columns, each said pixel comprising at least first and second sub-pixels having different respective first and second colors, the method comprising: driving groups of said pixels in turn to display a multicolor image frame, said driving of a group of pixels comprising driving first and second sub-groups of sub-pixels of respective said first and second colors; and wherein said driving further comprises driving a said group of pixels for a duration dependent upon a maximum drive level of a sub-pixel of a said sub-group.

U.S. Patent Application ((2008/0211793 to Ku, Chiung-Ching) discloses a driving apparatus for an OLED panel which comprises a common timing controller with a multi-line addressing algorithm and a segment controller with the multi-line addressing algorithm, to control a common driver and a segment driver, respectively, to drive the OLED panel. The common driver and the segment driver are connected to common lines and segment lines of the OLED panel, respectively. According to the multi-line addressing algorithm, the common driver can select at least two of the common lines at a same time.

Studying both MLA methods mentioned above, TMA and CMLA, they are disclosing substantial technically and mathematically different ways of working. TMA is based on a non-negative matrix factorization using an iterative method to approximate the original image by a product of two non-negative matrices, and TMA therefore involves complex processing of the whole image along with driver circuits using well matched current sources and sinks for both anodes and cathodes of the OLEDs whereas CMLA tries a lossless decomposition of the image data matrix into a sum of consecutive multi line matrices by a combinatorial algorithm, i.e. computed only by adding, substracting and comparing operations also using sequences of iterations, whereby at least three are needed, although simpler to implement than TMA it does nevertheless require significant processing of the image in order to minimize the peak currents for the OLED drivers.

In the prior art, there are different technical approaches to achieve the goal of implementing modern MLA schemes for FPD driving with limited processing power requirements in favor of a low power consumption and augmented life-time realized as integrated circuits. However these approaches use often solutions, which are somewhat technically complex and therefore also expensive in production. It would therefore be advantageous to reduce the expenses in both areas.

SUMMARY OF THE INVENTION

A principal object of the present invention is to realize a system for an FPD with a very economic multi line addressing scheme for OLED displays and essentially reduced complexity.

Another principal object of the present invention is to describe a very effective and power saving method for a multi line addressing scheme taking into account that for certain images there is a large number of lines that contain identical or near identical data, especially if they are showing sorts of regular patterns.

A further principal object of the present invention is to expand the multi line addressing scheme for such patterns by searching the whole display for identical lines that can be addressed completely in parallel and have no residual elements which need to be addressed via either a second multi line drive scheme (TMA) or a residual single line scan (CMLA, AMLA or XMLA).

Another further principal object of the present invention is to simplify the multi line addressing scheme and its decomposition method by tagging each line with a code that represents the nature and complexity of the data in the line and then quickly and simply comparing directly only those lines with matching tags thus effectively reducing the processing power required to identify identical lines.

Further another principal object of the present invention is to reduce the number of pre-charge operations for driving the OLED pixels for such patterns to their absolute minimum.

Still further another principal object of the present invention is to increase the lifetime for OLED-FPDs especially showing certain kinds of data, namely lifetime limiting worst case patterns, as the peak pixel current is hugely reduced.

A still further principal object of the present invention is to extend the multi line addressing scheme to more than one image frame.

Still another principal object of the present invention is to provide an effective and very manufacturable method for displaying OLED pixels with reduced power consumption implemented as an FPD driver integrated circuit (IC) for MOSFET technology.

Still a further principal object of the present invention is to allow a simpler multi line addressing scheme for OLED displays to be used without degrading its basic performance on FPD quality.

Another further object of the present invention is to realize a system for an FPD with low power consumption.

Further another object of the present invention is to give a method for reducing the operating temperature of FPD drivers.

Still another object of the present invention is to give a method whereby the lifetime expectations for FPD devices are enhanced.

Another still further object of the present invention is to use a simpler design for FPD drivers.

Still another object of the present invention is to simplify the design of the power supplies within FPD driver circuits.

Also still another object of the present invention is to simplify the production of FPD devices.

Further a still other object of the present invention is to make better use of battery power resources in portable devices using FPDs.

Another further object of the present invention is to allow for an economically manufacture of very large FPD devices.

These objects are achieved by a new circuit realizing a flat panel display capable to display images represented by image data, comprising: an image storage and processing block for storing and processing said image data to be displayed; a display and timing controller block controlling said display operation; an image pixel matrix containing a multitude of row and column arranged lines of pixel elements; one or more controlled row driver blocks; one or more controlled column driver blocks; and a pixel display operation for displaying said pixel elements employing a tagged multi line addressing (TMLA) operation applied to a row and/or column drive activated sequential pixel element display operation, whereby said TMLA operation signifies that during every operating sequence a decomposition operation of image data is taking place by searching all lines of an image for groups of identical lines that can be addressed completely in parallel and have no residual elements, consequently tagging each of these lines with a code that represents the nature and complexity of the data in the line and therefore decompose the tagged lines of image data into multi line domain and single line domain data in such a way, that tagged lines or groups of lines with matching tags are compared directly using lines with matching tags only, indicating their common and identical contents, which then is outputted as image data into related lines or groups of lines of the multiple line domain, whereby because these lines are forming groups of lines being commonly identical all with identical image data there are no left over residual image data for each of these groups of lines with matched tags and thus related groups of single lines in the single line domain data will comprise only image data with all zeroes and thus allowing for a display of said two data domains in separately activated pixel element display operations.

In accordance with the objects of this invention a new circuit is described, capable of realizing a a flat panel display capable to display images represented by image data, comprising: an image storage and processing means; a display and timing controller means; an image displaying means containing a multitude of row- and column-line arranged pixel elements; one or more row controlling means; one or more column controlling means; and a pixel display operation for displaying said pixel elements employing a tagged multi line addressing (TMLA) operation applied to a row and/or column drive activated sequential pixel element display operation, whereby said TMLA operation signifies that during every operating sequence a decomposition operation of image data is taking place by searching all lines of an image for groups of identical lines that can be addressed completely in parallel and have no residual elements, consequently tagging each of these lines with a code that represents the nature and complexity of the data in the line and therefore decompose the tagged lines of image data into multi line domain and single line domain data in such a way, that tagged lines or groups of lines with matching tags are compared directly using lines with matching tags only, indicating their common and identical contents, which then is outputted as image data into related lines or groups of lines of the multiple line domain, whereby because these lines are forming groups of lines being commonly identical all with identical image data there are no left over residual image data for each of these groups of lines with matched tags and thus related groups of single lines in the single line domain data will comprise only image data with all zeroes and thus allowing for a display of said two data domains in separately activated pixel element display operations.

Also in accordance with the objects of this invention a new method is described, implementing a power saving tagged multi line addressing (TMLA) algorithm for flat panel display drivers, comprising: providing a flat panel display device with a plurality of selectively activatable pixel elements arranged in an array of orthogonally oriented columns and rows, commonly also designated as lines, capable to display image data frames; providing according image data storage and processing means as well as display and timing controlling means; providing according row and column driver circuits for the selectively activatable pixel elements; searching all lines of an original image data frame from the image data storage and processing means for groups of identical lines that can be addressed completely in parallel and have no residual elements, that is analyze the whole display contents in order to identify such groups of lines; tagging each of these lines with a code that represents the nature and complexity of the data in the line and therefore allows for subsequently comparing and decomposing directly only those lines or groups of lines labeled with matching tags; decomposing the tagged lines of image data into multi line domain and single line domain data in such a way, that tagged lines or groups of lines with matching tags are compared directly using lines with matching tags only, indicating their common and identical contents, which then is outputted as image data into related lines or groups of lines of the multiple line domain, whereby because these lines are forming groups of lines being commonly identical all with identical image data there are no left over residual image data for each of these groups of lines with matched tags and thus related groups of single lines in the single line domain data will comprise only image data with all zeroes; preparing the data from the multi line domain and the data from the single line domain in such a way that two sets of image data are saved into distinct multi line and single line domain sets according to the output of the decomposition in step 'decomposing' above by looping back to step 'searching' above until all image data lines of the original image data frame are processed according to the TMLA algorithm; scanning sequentially the selectable display pixel elements of the array by selecting groupwise all the rows from the multi line domain frame groups with identical common contents thus activating all row/scan drivers for the accordingly selected rows from each currently selected group of the frame; driving for all selected rows of a certain active group with identical common contents from the multi line domain frame all the selected display pixel elements for every column sequentially or at the same time whilst activated by the current scan operation with the identical image data from the currently active group in the multi line domain thus activating collectively all column/data drivers for the accordingly selected columns from each active group; scanning sequentially the selectable display pixel elements of the array by selecting every single line with singly individual image data from the single line domain frame thus sequentially activating row by row all the row/scan drivers for each row of the frame; driving for all selected active rows with singly individual image data from the single line domain frame all the selected display pixel elements for every column sequentially or at the same time whilst activated by the current scan operation with the singly individual image data from the single line domain thus activating collectively all column/data drivers for the accordingly selected columns for each active row; and repeating all the 'scanning' and 'driving' steps above continuously until all groups of lines with identical image data from the multi line domain and all singly individual image data from the single line domain are being operated upon whereby its order is arbitrary and furthermore an appropriate interleaving of scanning and driving steps is taken into account.

Finally in accordance with the objects of this invention the method is described again more generally, a method for implementing a tagged multi line addressing (TMLA) algorithm for flat panel displays comprising: providing an image displaying means containing a multitude of row and column arranged lines of pixel elements capable of displaying image data in form of image data frames; providing an image storage and processing means capable to implement uniquely TMLA algorithm related parts regarding storing and processing calculations of the image data frames; providing a display and timing controller means capable to implement uniquely TMLA algorithm related parts regarding synchronous and sequential control and drive operations on the image data frames; providing one or more pixel row controlling means capable to scan display pixels according to the uniquely TMLA related prescriptions of the TMLA algorithm; providing one or more pixel column controlling means capable to drive display pixels according to the uniquely TMLA related prescriptions of the TMLA algorithm; establishing as TMLA algorithm a sequentially operating multi line addressing mechanism for addressing and driving the pixel elements by pixel row and column controlling means in such a way that a decomposition of the image data into multi line domain and single line domain data takes place, whereby all lines of image data frames are tagged with a code that represents the nature and complexity of the data in the line and therefore allows for subsequently comparing and decomposing directly only those lines or groups of lines labeled with matching tags in order to find their common contents; determining as first part of the TMLA algorithm the common contents of all image data lines by comparing lines of image data with matching tags thus building multiple groups of lines whereby the common contents from all lines within such groups of lines is then outputted each with identical image data for all lines in these groups of lines into the respectively related lines of the multiple line domain; identifying as second part of the TMLA algorithm the left over residual data for all currently compared image data lines amongst these matching groups of lines as individual contents singled out into accordingly related groups of single lines in the single line domain; continuing as third part of the TMLA algorithm the comparing and identifying for a possible next matching group of lines of image data by looping back to step 'determining' above until all lines of the currently processed image data frame are being operated upon, thus creating possibly multiple matching groups of lines each with identical image data in the multi line domain and accordingly generated related single lines in the single line domain; operating the row driver circuits as multiplexed scan drivers capable to select one or more rows of display pixels and operate the column driver circuits as image data drivers capable to drive one or more columns of display pixels for one or more rows, both sequentially or at the same time according to the prescriptions of the TMLA algorithm; displaying all the groups of common image data from the multi line domain in a groupwise synchronously pixel element data display operation for every pixel element in each column during an all the multiple rows of the group comprising sequence of pixel driving activations for the current frame; and displaying the individual image data from every line in the single line domain in a pixel element data display operation for every pixel element in each column during the single row oriented sequence of pixel activations for the current frame.

BRIEF DESCRIPTION OF THE DRAWINGS

In the accompanying drawings forming a material part of this description, the details describing a typical embodiment of the invention are shown:

FIG. 1 Prior Art exhibits the electrical schematics of a typical display driver and control circuit complete with OLED pixel array or matrix having model character as an exemplary embodiment for an FPD according to this invention proposing a new multi line addressing technique.

FIG. 2A Prior Art demonstrates the operation of a passive matrix circuit in a schematized way, however considering OLEDs with parasitic elements and matrix structures with losses.

FIG. 2B Prior Art illustrates the operation of MLA schemes within a passive matrix OLED circuit comparable to the schematics of FIG. 2A Prior Art.

Figure 3:
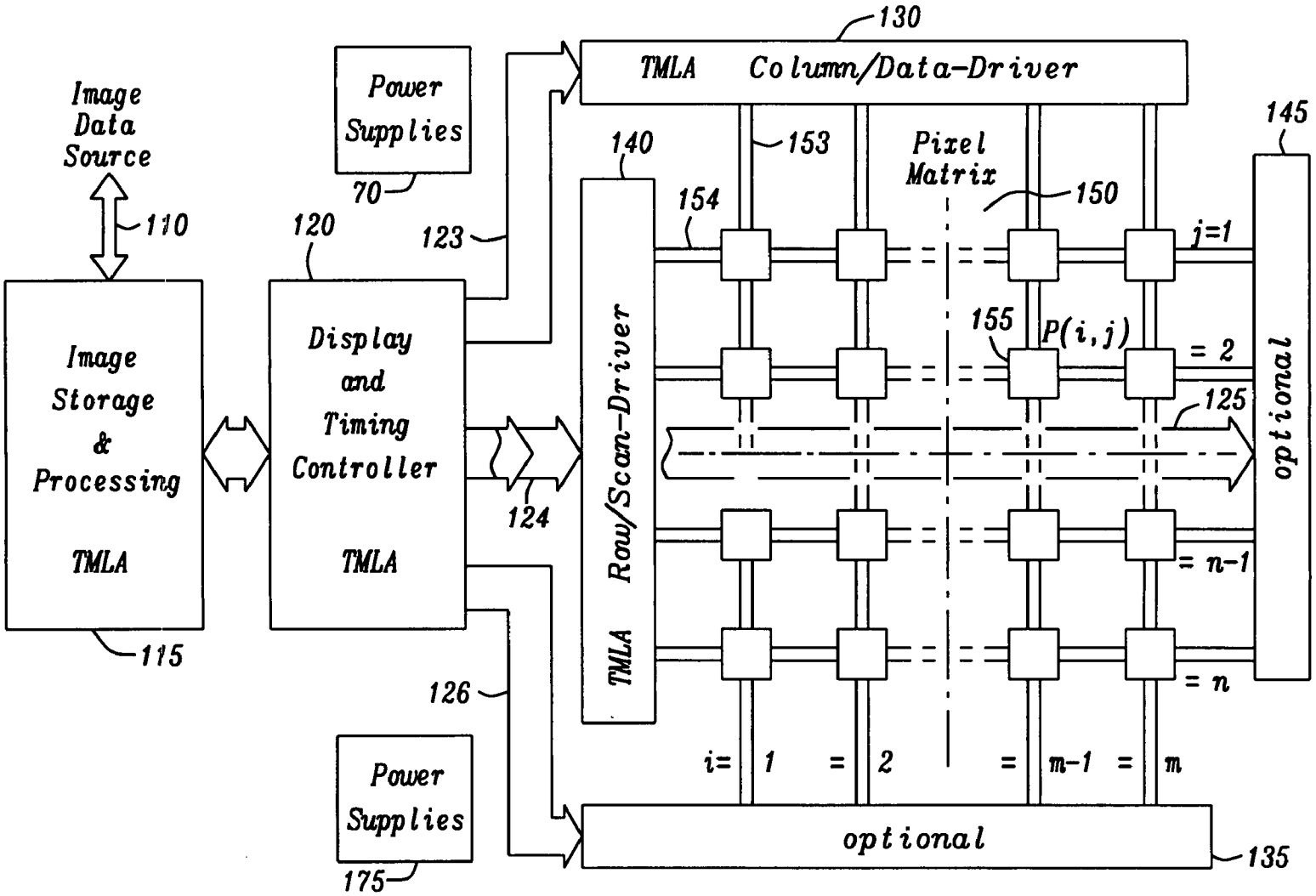
FIG. 3 illustrates by the help of modified electrical schematics an exemplary embodiment for a new FPD device incorporating new units and new driver circuits employing the new 'Tagged Multi Line Addressing' (TMLA) scheme according to this invention proposing a new simplified and amended calculation technique.

(TMLA) scheme as described and explained by FIG. 3, thus allowing substantial power savings and improved lifetime for FPD devices equipped with the TMLA method.

DESCRIPTION OF THE PREFERRED EMBODIMENTS

The preferred embodiments disclose novel realizations for display controller and driver circuits for FPDs solving the problem of inherent high power consumption of OLED displays and unwanted elevated power consumption by additional MLA scheme calculation operations and are described here by one exemplary showcase circuit of an FPD and especially by a new method of operation according to this invention. The higher the resolution of an FPD with a certain size, the more lines, i.e. rows and columns does it contain. Inherent high power consumption of higher resolution (high-res) OLED displays, especially troublesome for PM types, but to a lesser extent also found within AM types, not only reduces the operating time of portable, battery powered appliances but also reduces the lifetime of OLED displays by heating up the OLED pixel diodes. The reason for this is that in conventional SLA modes the full luminance driving current must be injected into each OLED pixel diode within only one time period for one horizontal line scan, the time during which each of the rows is selected. The more rows there are to be scanned during one frame period the lesser time is left over for one row, because the repetition rate for the frames has to remain always the same, determined by the human eyes' ability to integrate an image as a whole from the scanned lines and thus constantly leaving only 1/60 sec (or 1/50 sec; usually corresponding to the frequency of the mains supply) time for writing all rows, calculated from repetition rates of 60 (50) images per second, where 25 images per second is the lowest recommended rate, in order to get a stable visual impression without flicker. If dual scan techniques (used mainly in LCD or AMOLED displays) are used, this alleviates to doubled durations (1/30 or 1/25 secs), but only every other line is written then. This means that as the resolution is increased a higher current must be injected into the OLED pixel diode over a shorter period of time in order to achieve the desired brightness; the visually perceived brightness from an OLED being a product of supplied current value and time applied. High currents are however accelerating the aging process that occurs inside the OLEDs caused by higher temperature due to diode losses, thus reducing the intensity of their light output over time. Additionally higher currents and higher voltages owing to drive more rows and columns of high-res displays also mean higher resistive and capacitive losses as a result of longer and smaller wires and fewer empty space left for such displays, having the same dimensions otherwise. Thus the importance of successful MLA schemes can not be overemphasized.

From the above it is rather evident that a multitude of controversial issues and dependent facts—chosen from an individual technically solution—are influencing each other in such a way, that there still is room for advances especially in driving and addressing algorithms and circuits. Several other aspects are also taken care of in forming the Column/Data driver signals, so as there should not be any residual DC-offset voltage left when integrated over operation time of the FPD, because of obnoxious material degradation effects in each OLED pixel e.g. caused by electromigration, thus also limiting lifetime. On the other hand, if all the vertical Column/Data lines could be driven at one time, this could also be an option for the horizontal Row/Scan lines, which is what MLA/MRA schemes propose, namely to select more than one Line or Row at the same time. Extending this to its limits ends up at the final matrix addressing scheme, the particular case where all Row/Scan lines are selected at the same time, which is also known as Total Matrix Addressing (TMA) scheme. In order to better understand the reasons behind the increasing application and implementation of MLA schemes in FPD driver circuits, an overview of their advantages and drawbacks shall be given here.

The advantages of MLA schemes include:

- Lower resulting driving voltages (mainly LCD/LED) and/or peak currents (LED) as compared to SLA drive schemes.
- Power saving due to more economical numbers and ways of driving and charging processes.
- Better contrast and reduced display cross-talk issues thus improved display quality.
- Faster frame response time, no motion blur—thus suitable for faster response FPD devices for video and animation display, although response times for OLEDs are already significantly better as for LCD devices.
- Reduction of the Frame Response Effect, which can be noticeable especially in PMOLED devices.
- Other possible advantages can be reached by applying sub-frame algorithms and multiple scan, procedures.

As main drawback the high requirements for display data processing have to be called first, especially for large displays. MLA calculations can generally be represented by matrix operations, accounting for various aspects in image contents, such as patterns, stochastic distributions etc.; other ancillary aspects of technical nature such as the resulting driving waveforms, the resulting voltage levels and the driving power reduction are also incorporated into the reasonings and can make the mathematical theories complicated and in consequence their processing really heavy. In order to simplify hardware implementation, various algorithms are proposed and evaluated, but as a rule of thumb may be regarded: the more lines are to be included into the calculations (up to TMA schemes) and the more ancillary conditions are considered the more demanding the processing of the proposed solutions becomes. High processing requirements however ask for fast processors and large memories, thus processing power may constitute another possible drawback of MLA schemes to be considered.

As already explained above there is a large variety of circuits usable for FPDs and their driver circuits. They all have in common that they comprise some standard components in varying configurations such as an Image Storage and Processing block, a Display & Timing Controller block, a Pixel Matrix normally set-up as a rectangular X-Y array of equally spaced OLED Pixels forming the display screen area together with their needed corresponding X/Y-Driver and Y/X-Driver circuits as shown in FIG. 1 Prior Art above. Various means for Power Supply are also included as shown. The technical approach to achieve the goal of avoiding most of the disadvantages with known FPD driver circuits is lowering the power consumption of an FPD and its current and voltage demands during image display operations whereby the needed computations and OLED pixel driving actions are effectively reduced introducing the 'Tagged Multi Line Addressing' (TMLA) scheme according to this invention. Using the intrinsic advantages of that solution—as described later on in every detail—the construction of the circuits and the method for using these circuits according to the invention as realized with standard MOS technology is described and explained.

Contemplating now FIG. 3, TMLA modified electrical schematics exemplifying an FPD device according to this invention are depicted, wherefrom can be recognized an Image Data Source 110 being connected via a bi-directional data bus and feeding its image data stream normally comprising a multitude of image frames into an TMLA Image Storage & Processor 115 unit, capable of storing at least one image frame, whereby every image frame contains in general successive image data from said incoming image data stream. That TMLA Image Storage & Processor 115 unit is again bi-directionally connected to a TMLA Display & Timing Controller 120 unit, comprising inter alia data and/or signal Logic circuits and data and/or signal Processor capabilities, whereby all Processor units may be implemented e.g. in form of a Digital Signal Processor (DSP) and/or any other general purpose Processor with Central Processing Unit (CPU) and normal Random Access Memory (RAM) and/or Read Only Memory (ROM) modules or even additionally equipped with special Electrical Programmable (EP)-ROM or other One Time Programming (OTP) memory modules. As Processor may also be understood every other device capable to resolve the required processing tasks like finite state machines, logical networks and sequencers, or other dedicated hardware such as ASIC (Application Specific Integrated Circuit) or FPGA (Field Programmable Gate Array) devices and timers. The TMLA Display & Timing Controller 120 unit is then preparing and conditioning those image frame data as they come in from the Image Storage 115 unit and is delivering these data now in an appropriately transformed manner via image data and control signal bus systems 123, 124, 125, and 126 to the respective, closely display matrix adapted electronic TMLA driver units 130, 135, 140, and 145 of the FPD's literal Pixel Matrix 150 (of size m×n). Said Pixel Matrix 150 of the FPD includes a plurality of X-Lines 153 (i=1, 2 . . . m−1, m) extended along a first direction of an array substrate serving as material medium for the screen, a plurality of Y-Lines 154 (j=1, 2 . . . n−1, n) extended along a second direction of the array substrate that is substantially perpendicular to the first direction, and a plurality of pixel or sub-pixel 155 elements P(i, j) each electrically connected to one of the X-Lines and one of the Y-Lines. In this manner a Cartesian X-Y system of coordinates is established, thus making up the OLED screen area of size (m×n). As far as the TMLA driver units 130, 135, 140, and 145 are concerned, these must be capable to implement TMLA specific requirements, such as to drive multiple Scan Rows 140 at the same time, therefore named here TMLA Row/Scan-Driver 140 and as corresponding Column/Data-Driver 130 being able to modulate the driven pixel or sub-pixel currents and PWM image data according to TMLA results and therefore designated here as TMLA Column/Data-Driver 130. Additional functions like pre-charging and dis-charging OLED pixels may also be implemented by these drivers. It shall also be mentioned that driver circuits 135 and 145 together with their data busses 125 and 126 may be optional. From this can then be deduced that all the horizontally 154 and vertically 153 running data, select, scan, and control signals 153, 154 leading to their related sub-pixel circuits within 155 are possibly bundled in signal bus lines comprising multiple wires. Equally should be mentioned that the display matrix area may be separated into multiple sub-areas used for displaying only partial frames, so-called sub-frames, together with an appropriate adaptation of the MLA algorithms, the corresponding driver circuits as well as data and control signals. In order to being able to fulfill all the necessary tasks the mentioned display driver circuits or units 130, 135, 140, and 145 may also contain needed sub components such as memory registers, shift-registers, switches, multiplexers, voltage level shifter circuits, programmable voltage and/or current sources and/or sinks, and additional clocks or timers. Especially also pixel and sub-pixel pre-charge facilities shall be counted in here.

The display operations for the OLEDs can be implemented by these drivers in various ways, from simple linear driving methods whereby the pixel/sub-pixel elements are driven following directly the original image data organized according to the matrix structure of the FPD in columns and rows and thus sequentially and linearity displaying these image data by their respective pixels without any further interactions to more sophisticated driving methods such as by multi line addressing schemes operating in driving current/voltage saving and thus electrical power saving modes. Some of these have already been mentioned above. All these multi line addressing schemes have in common a more or less complicated decomposition algorithm, which is the prerequisite for separating image data into Multi line data (in the M-domain) and Single line data (in the S-domain) which are then displayed separately and in power saving ways. Another multi line addressing scheme, the AMLA algorithm according to another invention of the same applicant now does this decomposition in a simplified manner, namely by maximizing the Multi line data in the M-domain and minimizing the Single line data in the S-domain, which is achieved by outputting all the common parts of line data for each number of pixels compared in the analyzed rows into the Multi line M-domain sub-frame and keeping only the residual parts of single line data in the Single line S-domain sub-frame. Still another multi line addressing scheme, the XMLA algorithm according to still another invention of the same applicant extends the AMLA algorithm in such a way, that the decomposition is expanded to its widest possible range and to a best match in order to further optimize the results of this decomposition. As can be deduced from the descriptions these algorithms are sufficiently simple and easy to implement. Moreover, the chosen algorithms do not suffer from numerical instabilities, just computing a lossless decomposition giving a solution in real-time, i.e. within one image frame period. Which one of these calculated sub-frames is then displayed first is depending from experience, can be also used as degree of freedom in the MLA algorithms. Thus the designation first and second in the following does not imply its real ordering. Furthermore, the display operations can also be realized in such a way, where interleaving the M-domain and the S-domain operations is done whenever appropriate under varying point of views.

Introducing the new 'Tagged Multi Line Addressing' (TMLA) scheme into an FPD driver circuit reduces the peak and needed pre-charge currents of the OLEDs even more substantially than those other known MLA schemes. TMLA operates in a similar way as the AMLA and XMLA, CMLA and TMA algorithms do, and in fact could be applied also to them as expansion. With all addressing schemes used hitherto it has normally been assumed that all lines are different, that is they contain unique data. However it is clear that for certain images—test patterns and menu screens are a primary example—there are a large number of lines that contain identical or near identical data. Therefore in a preparatory step TMLA scans the incoming image data to find and identify such lines. This is achieved rather simply by tagging each line with a code that represents the nature and complexity of the data in the line and which then allows in another inserted step an efficient M- and S-domain decomposition operation by quickly and simply comparing directly only those lines with matching tags—this vastly reduces the processing power required to identify identical lines and allows potentially huge savings in peak pixel current. For example an all white display will have the same peak power as if it were an active matrix display; all pixels will be on all the time where a certain minimum driving current is flowing. A checker board pattern would be operating at only two times this minimum current—regardless of the size of the display. Furthermore for such patterns the number of pre-charges is reduced to their absolute minimum. The new TMLA method is therefore intended to widen the scope of multi line addressing schemes by searching the whole display for identical lines that can be addressed completely in parallel and have no residual elements which need to be addressed via either a second multi line drive scheme (TMA) or a residual single line scan (CMLA, AMLA or XMLA). This tagging of each line with a code that represents the nature and complexity of the data in the line signifies that structurally closely related lines are given matching tags and it is then easily possible to quickly and simply compare only those lines with matching tags in order to find all the lines with identical contents which then are addressed completely in parallel and therefore having no residual elements, as already described above. Thus an inherently accompanying analysis of the incoming image data comparable to more sophisticated methods in image and pattern recognition is silently done by that method of labeling with tags. In particular with TMLA, each image or video frame output is decomposed into only two sub-frames, therefore normally only one frame of image data is needed for processing and driving, which means data storage and memory requirements are minimized. The final goal is therefore to decompose the incoming image data into two sub-frames, one within the M-domain, the other within the S-domain, the overlay (addition) of which is then equal to the original image which can be displayed however more economically using OLED displays, because by use of the TMLA algorithm the Single line data are minimized to their absolute minimum and the peak currents (determined by the Multi line data) are maximally optimized, thus extending the lifetime of the OLEDs and reducing the power consumption of the FPD. For displays showing images containing certain kinds of data (especially those showing some regularities), the peak pixel currents are hugely reduced, which will increase the lifetime of the OLED displays, where life time is defined using worst case picture data and it is this data that this invention targets specifically along with those other data arrays which are hard to address with conventional schemes.

During the first of these sub-frames the rows are driven two or more at a time with the same data delivered by the M matrix from the multi line domain. Driving OLED column pixels for two or more rows using MLA schemes in PMOLED structures only with columnwise identical image data is a prerequisite: all column drivers (controllable current sources) can only feed the same currents to their selected diodes i.e. to the diodes connected to their respective column wires, (in AMOLED devices there are additional actions and provisions for columns thinkable, removing this prescript). That is in PMOLED arrays, a lower OLED peak current applied to each diode is made possible over the longer summed up period of time, now available for that whole number of selected two or more rows currently in scanning mode, where all OLED pixels in each column receive the same image data or OLED currents to generate the according luminosities. Lowering the peak amplitudes of the currents flowing over a longer time by MLA methods and thus reaching the same brightness from the shining OLEDs as in SLA cases with higher amplitude currents in shorter periods means lowering power consumption because of the quadratic laws for current i(t) or voltage u(t) within the formula for electric power: $p(t) \rightarrow u(t)i(t)dt \rightarrow i(t)^2R\,dt \rightarrow$ or $u(t)^2/R\,dt$, all to be integrated over time t to get the total power consumption. A first subframe with M matrix data is thus written completely in multi line mode and should preferably contain the essential bright shining parts of the image, because generating high intensity OLED pixels in multi line mode allows for driving these image pixels with lowered amplitude currents at longer driving periods. Power savings are thus maximized. Parts of the image data representing high luminance parts are therefore preferably to be found in the M domain, which inter alia characterizes the TMLA decomposition method. The technique explained here for the TMLA algorithm is applicable within the AMLA and XMLA algorithms and also the CMLA algorithm previously described.

The basic concept behind all the MLA schemes is to look for commonalities in the pixel values and the accompanying method then is to be able to drive such lines with common contents (in the M-domain) in parallel. If more than one frame is taken into account contents which doesn't change between different frames may be treated in this same way. It shall therefore be mentioned here, that a further expansion of the TMLA algorithm is possible in so far as the decomposition calculations to obtain the M-domain and S-domain data can be widened to include more than one image frame from the incoming image data stream in a roll-over manner, i.e. always looking at two image data frames of original data as input, then applying the TMLA algorithm onto these two frames and creating an output in much the same roll-over manner but considering only one output image data frame in terms of M-domain and S-domain data for output, ready for displaying one actual frame only, driving the OLED pixels. In order to avoid too long a period without discharge of OLED pixels precautions have to be taken into account introducing discharge actions. These discharge actions have then to be performed additionally; these discharge actions are necessary to avoid degradation of OLED pixels by electromigration effects, which signifies an unwanted material transport on an atomic/molecular basis thus causing a pre-mature degradation of OLEDs. As a concluding remark shall be added, that with a passive matrix display the displayed image will always need to be refreshed in order to avoid fading effects due to the lack of sufficient storage capabilities within the pixel elements, an active matrix display however is capable to handle this already inherently, namely by providing additional storage capacitors within every single pixel drive circuit, thus allowing such a multi-frame operation.

To bear in mind: qualifying the circuit from FIG. 3 above for TMLA requires that especially the units 115 and 120, as well as drivers 130 and 140 are tailored for implementing the TMLA algorithm, therefore deserving the designations TMLA Image Storage & Processor 115 unit, TMLA Display & Timing Controller 120 unit, TMLA Column/Data-Driver 130, and TMLA Row/Scan-Driver 140 circuits.

Only one single pass through the image data of one frame or sub-frame is required during the processing of the TMLA algorithm, in contrast to CMLA which requires a minimum of three passes through the data. For some pictures that single pass approach is made even easier.

Figure 4A:
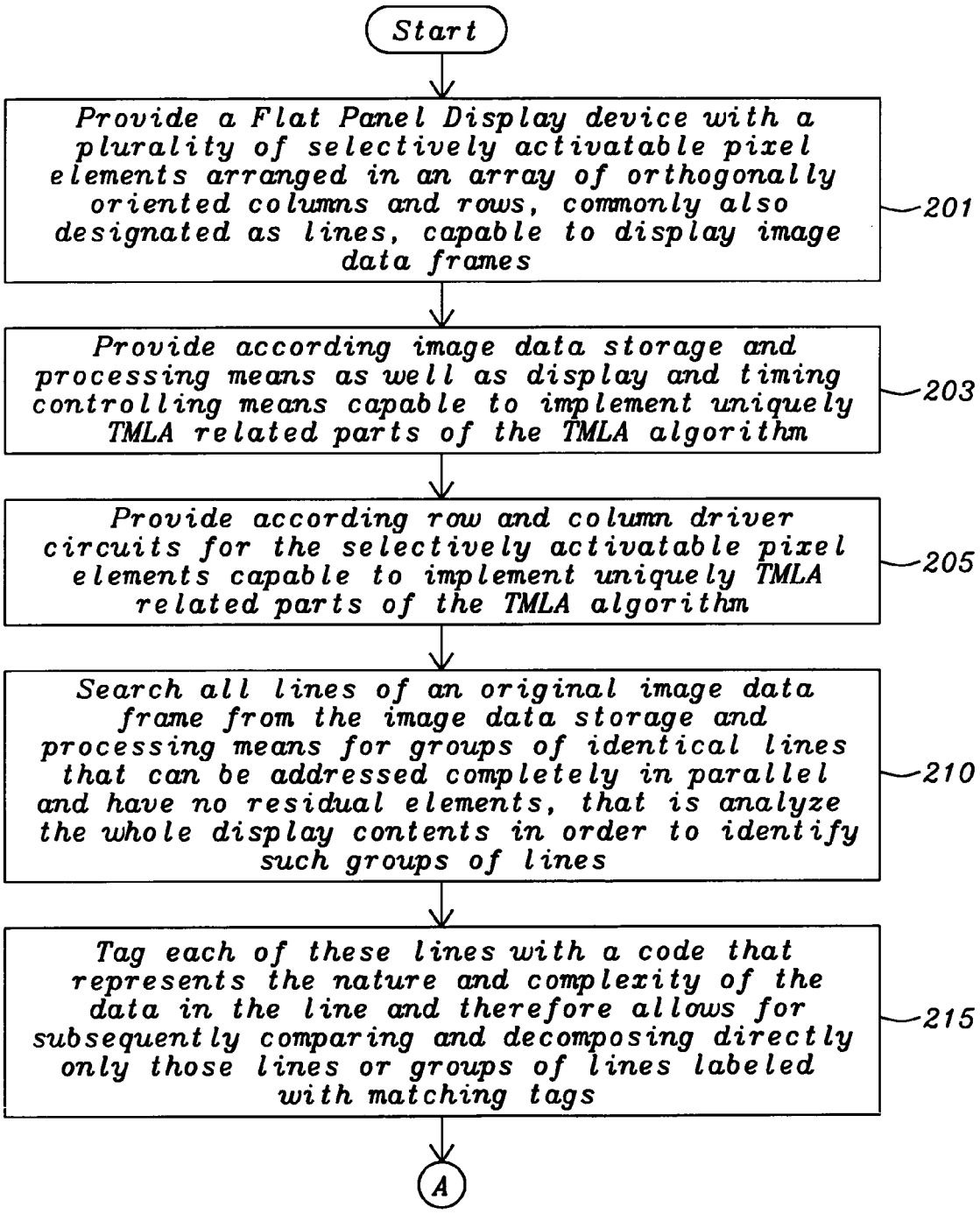
FIGS. 4A-4C describe with the help of a flow diagram that new 'Tagged Multi Line Addressing' (TMLA) scheme as shown in FIG. 3 according to the current invention and described in the specification in more detail.
Figure 4B:
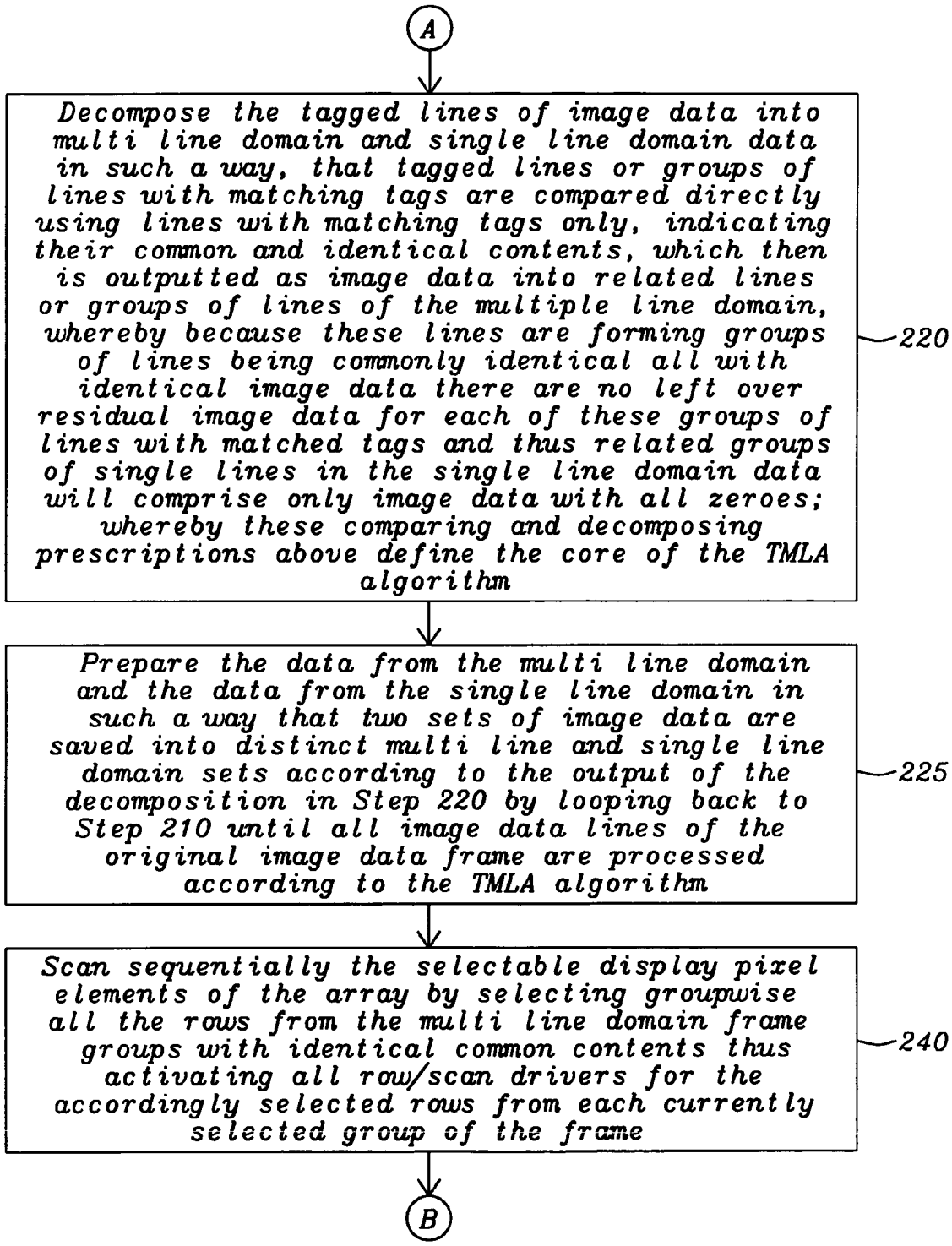
Figure 4C:
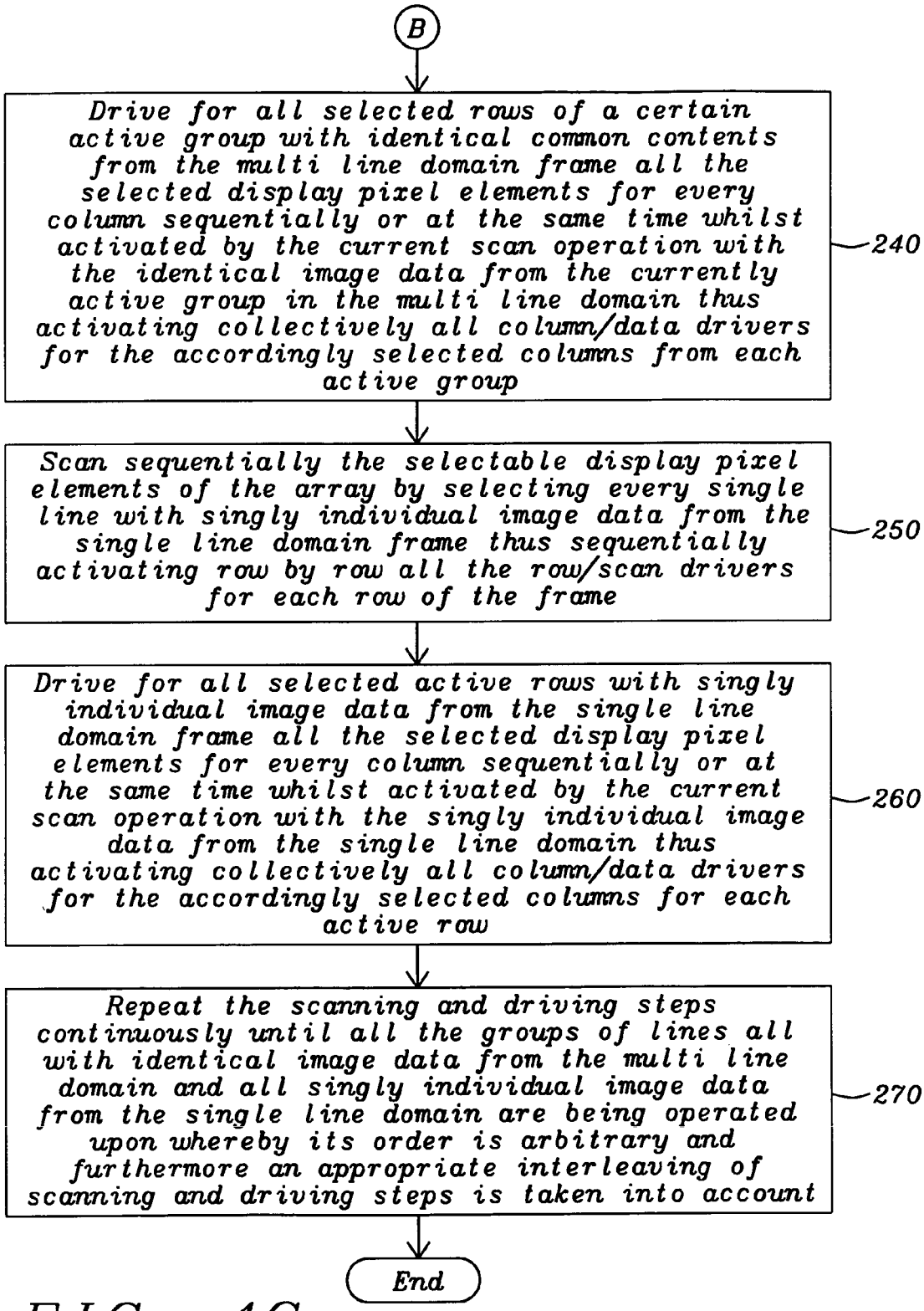

Regarding the flow diagram given by FIGS. 4A-4C the method for implementing an 'Tagged Multi Line Addressing' (TMLA) scheme for Flat Panel Display devices according to the invention and as illustrated by a circuit in FIG. 3 is now defined and described by its steps, wherein the first steps 201-205 provide a Flat Panel Display with a plurality of selectable pixel elements arranged in an array of orthogonally oriented columns and rows, commonly also designated as lines, capable to display image data frames, provide according image data storage and processing means as well as display and timing controlling means capable to implement uniquely TMLA related parts of the TMLA algorithm, and provide according row and column driver circuits for the selectively activatable pixel elements capable to implement uniquely TMLA related parts of the TMLA algorithm. Step 210 searches all lines of an original image data frame from the image data storage and processing means for groups of identical lines that can be addressed completely in parallel and have no residual elements, that is analyze the whole display contents in order to identify such groups of lines and Step 215 tags each of these lines with a code that represents the nature and complexity of the data in the line and therefore allows for subsequently comparing and decomposing directly only those lines or groups of lines labeled with matching tags. Step 220 decomposes the tagged lines of image data into multi line domain and single line domain data in such a way, that tagged lines or groups of lines with matching tags are compared directly using lines with matching tags only, indicating their common and identical contents, which then is outputted as image data into related lines or groups of lines of the multiple line domain, whereby because these lines are forming groups of lines being commonly identical all with identical image data there are no left over residual image data for each of these groups of lines with matched tags and thus related groups of single lines in the single line domain data will comprise only image data with all zeroes; whereby these comparing and decomposing prescriptions above define the core of the TMLA algorithm. Step 225 prepares the data from the multi line domain and the data from the single line domain in such a way that two sets of image data are saved into distinct multi line and single line domain sets according to the output of the decomposition in Step 220 by looping back to Step 210 until all image data lines of the original image data frame are processed according to the TMLA algorithm. Steps 230 and 240 are both handling the multi line domain data namely scanning sequentially the selectable display pixel elements of the array by selecting groupwise all the rows from the multi line domain frame groups with identical common contents thus activating all row/scan drivers for the accordingly selected rows from each currently selected group of the frame and then driving for all selected rows of a certain active group with identical common contents from the multi line domain frame all the selected display pixel elements for every column sequentially or at the same time whilst activated by the current scan operation with the identical image data from the currently active group in the multi line domain thus activating collectively all column/data drivers for the accordingly selected columns from each active group. In a comparable way Steps 250 and 260 are both handling the single line domain data, namely scanning sequentially the selectable display pixel elements of the array by selecting every single line with singly individual image data from the single line domain frame thus sequentially activating row by row all the row/scan drivers for each row of the frame and then driving for all selected active rows with singly individual image data from the single line domain frame all the selected display pixel elements for every column sequentially or at the same time whilst activated by the current scan operation with the singly individual image data from the single line domain thus activating collectively all column/data drivers for the accordingly selected columns for each active row. Finally Step 270 is repeating the scanning and driving steps continuously until all the groups of lines all with identical image data from the multi line domain and all singly individual image data from the single line domains are being operated upon whereby its order is arbitrary and furthermore an appropriate interleaving of scanning and driving steps is taken into account.

Figure 5A:
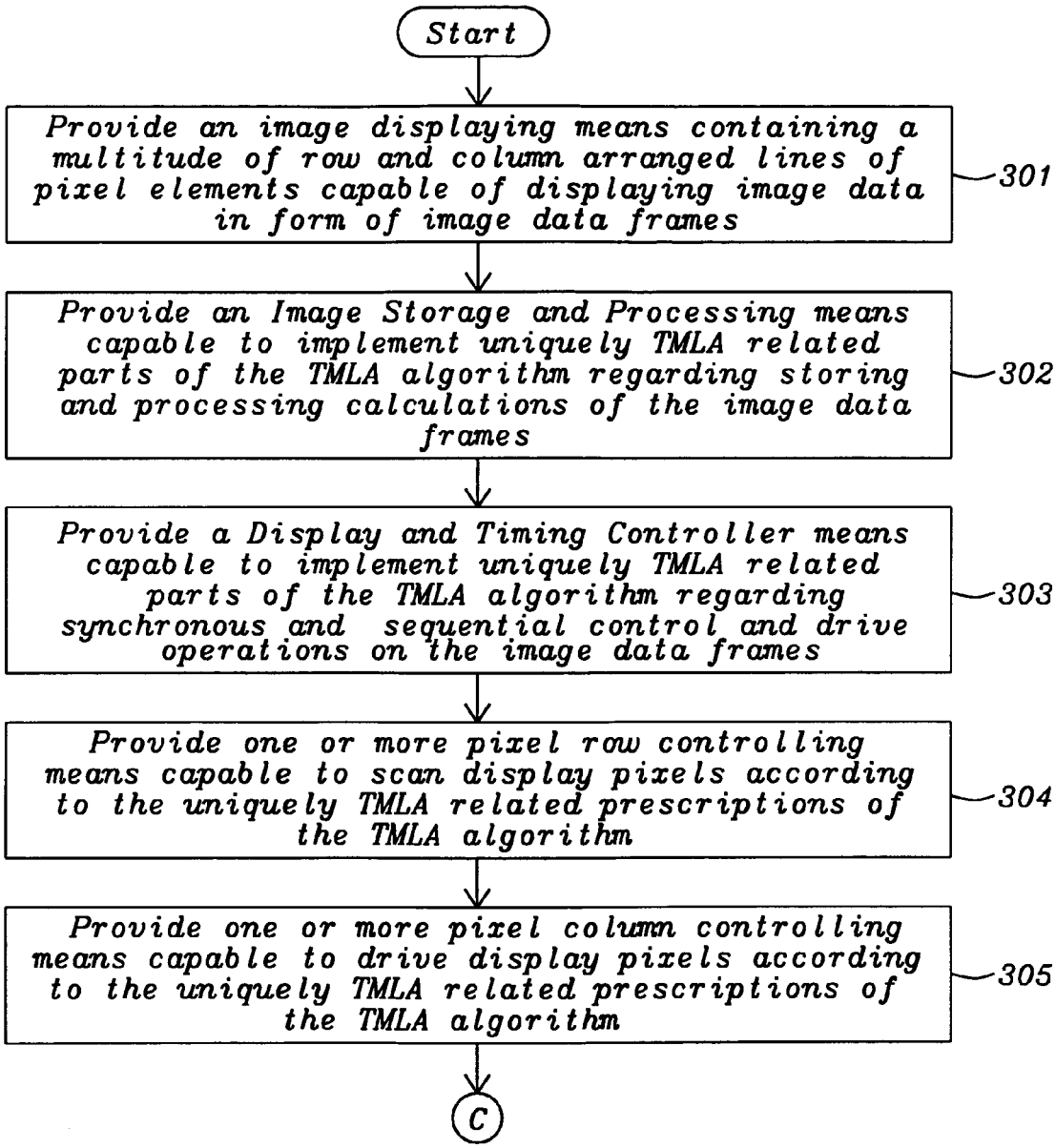
FIGS. 5A-5C describe again with the help of a flow diagram the application of this new method teached in the current invention and called 'Tagged Multi Line Addressing'
Figure 5B:
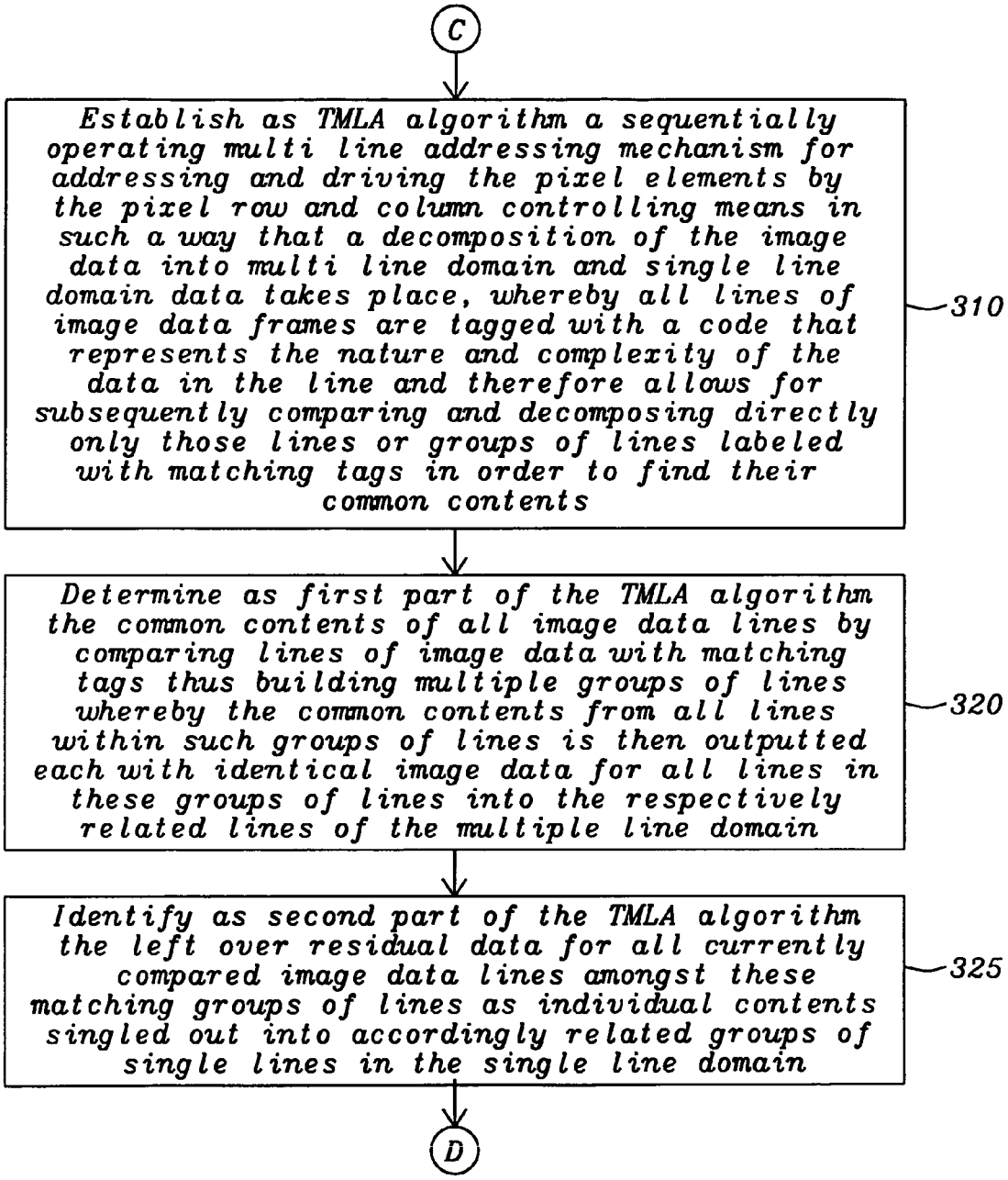
Figure 5C:
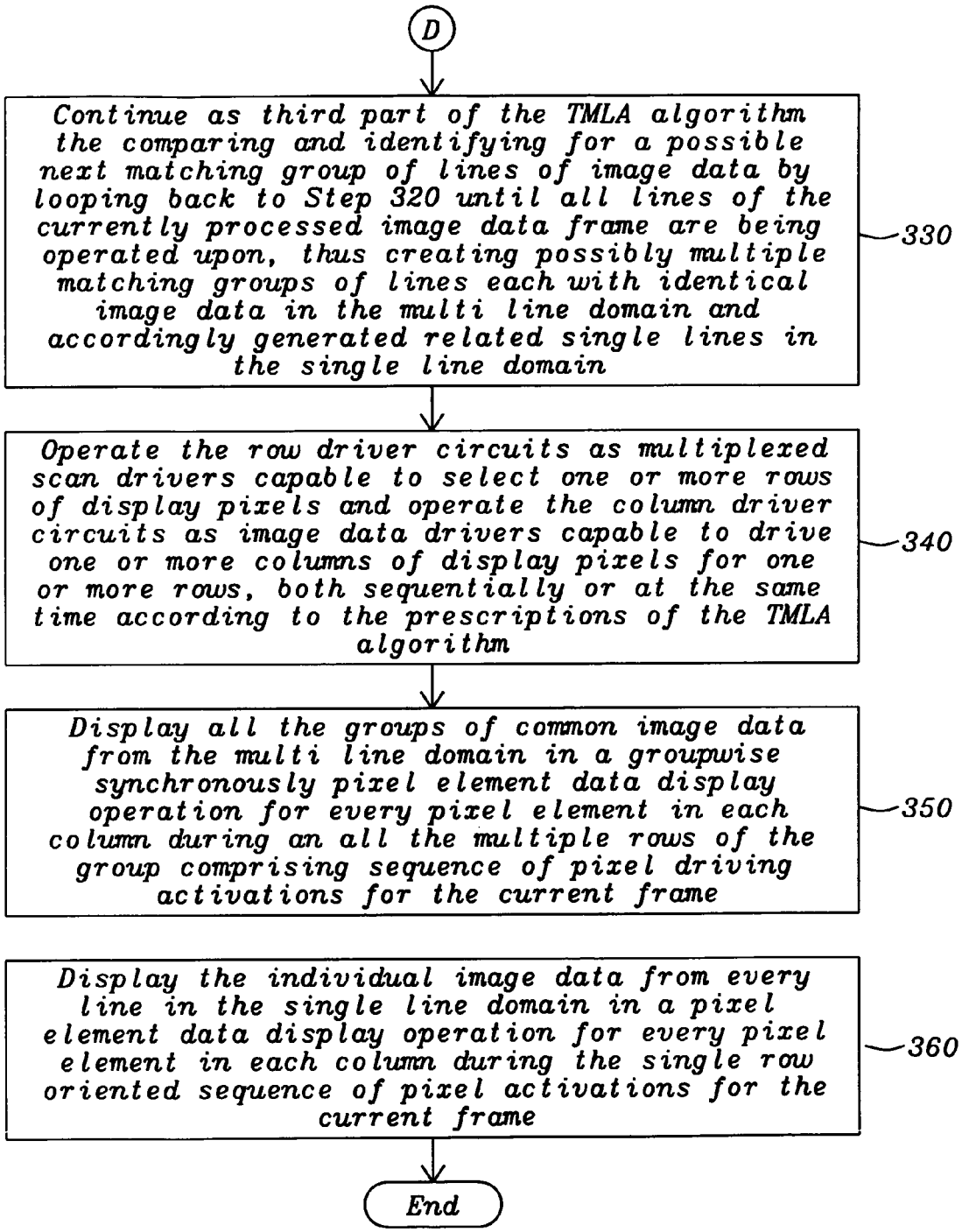

Regarding the flow diagram given by FIGS. 5A-5B the method for implementing an 'Extended Multi Line Addressing' scheme for Flat Panel Display devices according to the invention and illustrated by a circuit in FIG. 3 is now described in a different manner by the following steps, wherein the first steps 301-305 provide an image displaying means containing a multitude of row and column arranged lines of pixel elements capable of displaying image data in form of image data frames, an Image Storage and Processing means capable to implement uniquely TMLA related parts of the TMLA algorithm regarding storing and processing calculations of the image data frames, a Display and Timing Controller means capable to implement uniquely TMLA related parts of the TMLA algorithm regarding synchronous and sequential control and drive operations on the image data frames, one or more pixel row controlling means capable to scan display pixels according to the uniquely TMLA related prescriptions of the TMLA algorithm, and one or more pixel column controlling means capable to drive display pixels according to the uniquely TMLA related prescriptions of the TMLA algorithm. With Step 310 the TMLA algorithm is established as a sequentially operating multi line addressing mechanism for addressing and driving the pixel elements by pixel row and column controlling means in such a way that a decomposition of the image data into multi line domain and single line domain data takes place, whereby all lines of image data frames are tagged with a code that represents the nature and complexity of the data in the line and therefore allows for subsequently comparing and decomposing directly only those lines or groups of lines labeled with matching tags in order to find their common contents. Step 320 determines as first part of the TMLA algorithm the common contents of all image data lines by comparing lines of image data with matching tags thus building multiple groups of lines whereby the common contents from all lines within such groups of lines is then outputted each with identical image data for all lines in these groups of lines into the respectively related lines of the multiple line domain, whereby in Step 325 as second part of the TMLA algorithm the left over residual data for all currently compared image data lines amongst these matching groups of lines as individual contents singled out into accordingly related groups of single lines in the single line domain are identified. Step 330 continues as third part of the TMLA algorithm the comparing and identifying for a possible next matching group of lines of image data by looping back to Step 320 until all lines of the currently processed image data frame are being operated upon, thus creating possibly multiple matching groups of lines each with identical image data in the multi line domain and accordingly generated related single lines in the single line domain. Step 340 operates the row driver circuits as multiplexed scan drivers capable to select one or more rows of display pixels and also operates the column driver circuits as image data drivers capable to drive one or more columns of display pixels for one or more rows, both sequentially or at the same time according to the prescriptions of the TMLA algorithm. Finally Step 350 displays all the groups of common image data from the multi line domain in a groupwise synchronously pixel element data display operation for every pixel element in each column during an all the multiple rows of the group comprising sequence of pixel driving activations for the current frame and Step 360 displays the individual image data from every line in the single line domain in a pixel element data display operation for every pixel element in each column during the single row oriented sequence of pixel activations for the current frame.

It shall be mentioned here that the term frame may be replaced by the term sub-frame everywhere in the two descriptions of the TMLA algorithms and methods above, also should be mentioned that the order in which these frames or sub-frames with single line domain and multi line domain data are displayed is arbitrary and furthermore an appropriate interleaving of scanning and driving actions during display operations is taken into account whenever considered appropriate.

It is understood that the proposed embodiment with components as particularly shown here, and described and explained above is chosen only as a demonstration for the teachings and ideas of this invention. The teachings and ideas of the proposed schemes and methods can therefore also be applied to circuits with varying components, and also to circuits with other transistor technologies. Several hints and remarks to this conclusion have already been given above. It is especially not necessary that the display devices of the present invention comprise only pixel elements arranged as passive matrix. In other words, it is also possible to apply the present invention to display devices that perform active matrix display operations. Further steps for implementing such active matrix versions are referred to in the above given Active vs. Passive Matrix comparison section, especially using one or multiple separate control lines directly or indirectly connecting to OLEDs.

The current invention has now been electrically and technologically described and explained in great detail. The manufacturing process for semiconductor realizations in MOS technology is especially suited for these type of larger current source arrays.

Summarizing the essential features of the realization of the circuit we find, that in integrated circuit embodiments of the present invention a novel circuit and method is implemented, able to provide an easy and power saving algorithm implemented which altogether results in better reliability and quality products.

As shown in the preferred embodiment the novel system, circuits and methods provide an effective and manufacturable alternative to the prior art.

Consequently, although only one typical embodiment of the present invention has been described in detail, it should be understood that the present invention may be embodied in many other specific forms without departing from the spirit or scope of the invention. Substitutions and variations on the inventive concepts are possible and are within the skills of one skilled in the art given this disclosure. In view of the foregoing, it should be apparent that the present examples are to be considered as illustrative and not restrictive, and the invention is not to be limited to the details given herein, but may be modified within the scope of the appended claims. While the invention has been particularly illustrated and described with reference to the preferred embodiment, it will be understood by those skilled in the art that various changes in form and details may be made without departing from the spirit and scope of the invention. Having shown and explained the principles of this invention with the aid of the given method it should also be readily apparent to those skilled in the art that the invention can be modified in arrangement and structure without departing from such principles. We therefore claim all modifications coming within the spirit and scope of the accompanying claims.

What is claimed is:

1. A circuit, realizing a flat panel display capable to display images represented by image pixel data, comprising:

an image storage and processing block for storing and processing said image data to be displayed;

a display and timing controller block controlling said display operation;

an image pixel matrix containing a multitude of row and column arranged lines of image pixel elements;

one or more controlled row driver blocks;

one or more controlled column driver blocks; and a pixel display operation for displaying said image pixel elements employing a tagged multi line addressing (TMLA) operation applied to a row and/or column drive activated sequential image pixel element display operation, whereby said TMLA operation comprises during every operating sequence a decomposition of image pixel data by searching all lines of an image for groups of identical lines that can be addressed completely in parallel and have no residual elements using only pixel data calculation algorithms for said decomposition of image pixel data which are requiring only one single pass through said image pixel data, thereby, consequently tagging each of these lines with a code that represents the nature and complexity of said image pixel data in the line and therefore decompose the tagged lines of said image pixel data into multi line domain and single line domain data in such a way, that tagged lines or groups of lines with matching tags are compared directly using lines with matching tags only, indicating their common and identical contents, which then is outputted as image pixel data into related lines or groups of lines of the multiple line domain, whereby because these lines are forming groups of lines being commonly identical all with identical image pixel data there are no left over residual image pixel data for each of these groups of lines with matched tags and thus related groups of single lines in the single line domain data will comprise only image pixel data with all zeroes and thus allowing for a display of said two data domains in separately activated image pixel element display operations.

2. The circuit according to claim 1 wherein said image pixel matrix comprises a passive matrix device.

3. The circuit according to claim 1 wherein said image pixel matrix comprises an active matrix device.

4. The circuit according to claim 1 wherein said image storage and/or processing block comprises memory for more than one image frame.

5. The circuit according to claim 1 wherein said image storage and/or processing block comprises memory for only one single image frame.

6. The circuit according to claim 1 wherein said image storage and/or processing block comprises memory for parts only of an image frame.

7. The circuit according to claim 1 wherein said image storage and/or processing block comprises a digital processor.

8. The circuit according to claim 7 wherein said digital processor comprises an ASIC device.

9. The circuit according to claim 7 wherein said digital processor comprises an FPGA device.

10. The circuit according to claim 7 wherein said digital processor comprises a general purpose CPU and memory.

11. The circuit according to claim 10 wherein said memory comprises RAM.

12. The circuit according to claim 10 wherein said memory comprises ROM.

13. The circuit according to claim 1 wherein the components of said blocks are MOSFET components.

14. The circuit according to claim 13 wherein said MOSFET components are of the CMOS type.

15. The circuit according to claim 1 wherein said pixel elements comprise LEDs.

16. The circuit according to claim 15 wherein said LEDs comprise OLEDs.

17. The circuit according to claim 15 wherein said LEDs comprise PLEDs.

18. A circuit, realizing a flat panel display capable to display images represented by image pixel data, comprising:

an image storage and processing means;

a display and timing controller means;

an image displaying means containing a multitude of row- and column- line arranged image pixel elements;

one or more row controlling means;

one or more column controlling means; and a pixel display operation for displaying said image pixel elements employing a tagged multi line addressing (TMLA) operation applied to a row and/or column drive activated sequential image pixel element display operation, whereby said TMLA operation comprises during every operating sequence a decomposition of image pixel data by searching all lines of an image for groups of identical lines that can be addressed completely in parallel and have no residual elements using only pixel data calculation algorithms for said decomposition of image pixel data which are requiring only one single pass through said image pixel data, thereby, consequently tagging each of these lines with a code that represents the nature and complexity of the pixel data in the line and therefore decompose the tagged lines of image pixel data into multi line domain and single line domain data in such a way, that tagged lines or groups of lines with matching tags are compared directly using lines with matching tags only, indicating their common and identical contents, which then is outputted as image pixel data into related lines or groups of lines of the multiple line domain, whereby because these lines are forming groups of lines being commonly identical all with identical image pixel data there are no left over residual image pixel data for each of these groups of lines with matched tags and thus related groups of single lines in the single line domain data will comprise only image pixel data with all zeroes and thus allowing for a display of said two data domains in separately activated image pixel element display operations.

19. A method for implementing a flat panel display driver circuit using a power saving tagged multi line addressing (TMLA) algorithm for flat panel display drivers, comprising:

providing a flat panel display device with a plurality of selectively activatable pixel elements arranged in an array of orthogonally oriented columns and rows, commonly also designated as lines, capable to display image data frames;

providing according image data storage and processing means as well as display and timing controlling means;

providing according row and column driver circuits for the selectively activatable pixel elements;

searching all lines of an original image data frame from the image data storage and processing means for groups of identical lines that can be addressed completely in parallel and have no residual elements, that is analyze the whole display contents in order to identify such groups of lines;

tagging each of these lines with a code that represents the nature and complexity of the data in the line and therefore allows for subsequently comparing and decomposing directly only those lines or groups of lines labeled with matching tags;

decomposing the tagged lines of image data into multi line domain and single line domain data using only image data calculation algorithms for said decomposition of image data which are requiring only one single pass through said image data in such a way, that tagged lines or groups of lines with matching tags are compared directly using lines with matching tags only, indicating their common and identical contents, which then is outputted as image data into related lines or groups of lines of the multiple line domain, whereby because these lines are forming groups of lines being commonly identical all with identical image data there are no left over residual image data for each of these groups of lines with matched tags and thus related groups of single lines in the single line domain data will comprise only image data with all zeroes;

preparing the data from the multi line domain and the data from the single line domain in such a way that two sets of image data are saved into distinct multi line and single line domain sets according to the output of the decomposition in step 'decomposing' above by looping back to step 'searching' above until all image data lines of the original image data frame are processed according to the TMLA algorithm;

scanning sequentially the selectable display pixel elements of the array by selecting groupwise all the rows from the multi line domain frame groups with identical common contents thus activating all row/scan drivers for the accordingly selected rows from each currently selected group of the frame;

driving for all selected rows of a certain active group with identical common contents from the multi line domain frame all the selected display pixel elements for every column sequentially or at the same time whilst activated by the current scan operation with the identical image data from the currently active group in the multi line domain thus activating collectively all column/data drivers for the accordingly selected columns from each active group;

scanning sequentially the selectable display pixel elements of the array by selecting every single line with singly individual image data from the single line domain frame thus sequentially activating row by row all the row/scan drivers for each row of the frame;

driving for all selected active rows with singly individual image data from the single line domain frame all the selected display pixel elements for every column sequentially or at the same time whilst activated by the current scan operation with the singly individual image data from the single line domain thus activating collectively all column/data drivers for the accordingly selected columns for each active row; and repeating continuously 'scanning' and 'driving' steps from above either sequentially or continuously repeating the 'scanning' and 'driving' steps from above taken in parallel until all groups of lines with identical image data from the multi line domain and all singly individual image data from the single line domain are being operated upon whereby the order of that repeating is arbitrary and furthermore an appropriate interleaving of scanning and driving steps is taken into account in order to minimize power consumption by reducing precharge operations without degrading performance.

20. A method for implementing a flat panel display driver circuit using a tagged multi line addressing (TMLA) algorithm for flat panel displays comprising:

providing an image displaying means containing a multitude of row and column arranged lines of pixel elements capable of displaying image data in form of image data frames;

providing an image storage and processing means capable to implement uniquely TMLA algorithm related parts regarding storing and processing calculations of the image data frames;

providing a display and timing controller means capable to implement uniquely TMLA algorithm related parts regarding synchronous and sequential control and drive operations on the image data frames;

providing one or more pixel row controlling means capable to scan display pixels according to the uniquely TMLA related prescriptions of the TMLA algorithm;

providing one or more pixel column controlling means capable to drive display pixels according to the uniquely TMLA related prescriptions of the TMLA algorithm;

establishing as TMLA algorithm a sequentially operating multi line addressing mechanism for addressing and driving the pixel elements by pixel row and column controlling means in such a way that a decomposition of the image data into multi line domain and single line domain data takes place using only data calculation algorithms for said decomposition of image data which are requiring only one single pass through said image data, whereby all lines of image data frames are tagged with a code that represents the nature and complexity of the data in the line and therefore allows for subsequently comparing and decomposing directly only those lines or groups of lines labeled with matching tags in order to find their common contents;

determining as first part of the TMLA algorithm the common contents of all image data lines by comparing lines of image data with matching tags thus building multiple groups of lines whereby the common contents from all lines within such groups of lines is then outputted each with identical image data for all lines in these groups of lines into the respectively related lines of the multiple line domain;

identifying as second part of the TMLA algorithm the left over residual data for all currently compared image data lines amongst these matching groups of lines as individual contents singled out into accordingly related groups of single lines in the single line domain;

continuing as third part of the TMLA algorithm the comparing and identifying for a possible next matching group of lines of image data by looping back to step 'determining' above until all lines of the currently processed image data frame are being operated upon, thus creating possibly multiple matching groups of lines each with identical image data in the multi line domain and accordingly generated related single lines in the single line domain;

operating the row driver circuits as multiplexed scan drivers capable to select one or more rows of display pixels and operate the column driver circuits as image data drivers capable to drive one or more columns of display pixels for one or more rows, both sequentially or at the same time according to the prescriptions of the TMLA algorithm;

displaying all the groups of common image data from the multi line domain in a groupwise synchronously pixel element'data display operation for every pixel element in each column during an all the multiple rows of the group comprising sequence of pixel driving activations for the current frame; and displaying the individual image data from every line in the single line domain in a pixel element data display operation for every pixel element in each column during the single row oriented sequence of pixel activations for the current frame.

21. A method for implementing a flat panel display driver circuit using a power saving tagged multi line addressing (TMLA) algorithm for flat panel display drivers, comprising:

providing a flat panel display device with pixel elements arranged in rows and columns both also designated as lines capable to display image data frames comprising image data storage and processing means as well as display and timing controlling means together with according line driver circuits for each of said pixel elements, searching all lines of an original image data frame for groups of identical lines that can be addressed and displayed completely in parallel;

tagging each of these lines with a code that represents the nature and complexity of the data in the line; and decomposing the tagged lines of image data into multi line domain and single line domain data using only image data calculation algorithms for said decomposition of image data which are requiring only one single pass through said image data in such a way, that tagged lines or groups of lines with matching tags are processed directly using lines with matching tags only, indicating their common and identical contents, which then is being output as image data into related lines or groups of lines into the multiple line domain, whereby no residual image data for each of these lines or groups of lines with matched tags are left over and thus related lines or groups of lines in the single line domain data will comprise only image data with all zeroes.

22. The method according to claim 21 further comprising:

preparing the data from the multi line domain and the data from the single line domain in such a way that two sets of image data are saved into distinct multi line and single line domain sets according to the output of the decomposition in step 'decomposing' by looping back to step 'searching' until all image data lines of the original image data frame are processed according to said TMLA algorithm.

23. The method according to claim 21 further comprising:

scanning sequentially the selectable display pixel elements of the array by selecting groupwise all the rows from the multi line domain with identical common contents thus activating all row/scan drivers for the accordingly selected rows from each currently selected group of the frame;

driving for all selected rows of a certain active group with identical common contents from the multi line domain all the selected display pixel elements for every column sequentially or at the same time whilst activated by the current scan operation with identical image data from the currently active group in the multi line domain thus activating collectively all column/data drivers for the accordingly selected columns from each active group;

scanning sequentially the selectable display pixel elements of the array by selecting every single line with singly individual image data from the single line domain frame thus sequentially activating row by row all the row/scan drivers for each row of the frame; and driving for all selected active rows with singly individual image data from the single line domain frame all the selected display pixel elements for every column sequentially or at the same time whilst activated by the current scan operation with the singly individual image data from the single line domain thus activating collectively all column/data drivers for the accordingly selected columns for each active row.

24. The method according to claim 21 further comprising:

repeating continuously the 'scanning' and 'driving' steps either sequentially or continuously repeating the 'scanning' and 'driving' steps from above taken in parallel until all groups of lines with identical image data from the multi line domain and all singly individual image data from the single line domain are being operated upon whereby the order of that repeating is arbitrary and furthermore an appropriate interleaving of scanning and driving steps is taken into account in order to minimize power consumption by reducing precharge operations without degrading performance.

25. A method for implementing a flat panel display driver circuit using a power saving tagged multi line addressing (TMLA) algorithm for flat panel display drivers, comprising:

providing an image displaying means containing a multitude of row and column arranged lines both also designated as lines of pixel elements capable of displaying image data by according line driver means for each of said pixel elements comprising also image data storage and processing means as well as display and timing controlling means together with one or more pixel row and pixel column controlling means capable to scan display pixels according to the uniquely TMLA related prescriptions of said TMLA algorithm; and establishing as TMLA algorithm a sequentially operating multi line addressing mechanism for addressing and driving said pixel elements by pixel row and column controlling means in such a way that a decomposition of the image data into multi line domain and single line domain data takes place using only data calculation algorithms for said decomposition of image data which are requiring only one single pass through said image data, whereby all lines of image data frames are tagged with a code that represents the nature and complexity of the data in the line and therefore allows for subsequently comparing and decomposing directly only those lines or groups of lines labeled with matching tags in order to find their common contents.

26. The method according to claim 25 further comprising:

determining as first part of the TMLA algorithm the common contents of all image data lines by comparing lines of image data with matching tags thus building multiple groups of lines whereby the common contents from all lines within such groups of lines is then being output each with identical image data for all lines in these groups of lines into the respectively related lines of the multiple line domain;

identifying as second part of the TMLA algorithm the left over residual data for all currently compared image data lines amongst these matching groups of lines as individual contents singled out into accordingly related groups of single lines in the single line domain; and continuing as third part of the TMLA algorithm the comparing and identifying for a possible next matching group of lines of image data by looping back to step 'determining' above until all lines of the currently processed image data frame are being operated upon, thus creating possibly multiple matching groups of lines each with identical image data in the multi line domain and accordingly generated related single lines in the single line domain.

27. The method according to claim 25 further comprising:

operating the row driver circuits as multiplexed scan drivers capable to select one or more rows of display pixels and operate the column driver circuits as image data drivers capable to drive one or more columns of display pixels for one or more rows, both sequentially or at the same time according to the prescriptions of the TMLA algorithm;

displaying all the groups of common image data from the multi line domain in a groupwise synchronously pixel element data display operation for every pixel element in each column during an all the multiple rows of the group comprising sequence of pixel driving activations for the current frame; and displaying the individual image data from every line in the single line domain in a pixel element data display operation for every pixel element in each column during the single row oriented sequence of pixel activations for the current frame.

* * * * *

UNITED STATES PATENT AND TRADEMARK OFFICE

CERTIFICATE OF CORRECTION

PATENT NO. : 8,395,565 B2
APPLICATION NO. : 12/455527
DATED : March 12, 2013
INVENTOR(S) : Alan Somerville and Kevin Jones It is certified that error appears in the above-identified patent and that said Letters Patent is hereby corrected as shown below:

Title Page, Inventors (75), delete additional Inventor "Kevin Jones, Kirchhem/Teck-Nabern (DE)" and replace with --Kevin Jones, Swindon, United Kingdom--.

Signed and Sealed this
Sixteenth Day of July, 2013

Teresa Stanek Rea
*Acting Director of the United States Patent and Trademark Office*